United States Patent [19]

Kaneda

[11] 4,079,292

[45] Mar. 14, 1978

[54] ARC DISCHARGE SUSTAINING CIRCUIT SYSTEM FOR A DISCHARGE LAMP

[75] Inventor: Isao Kaneda, Otsu, Japan

[73] Assignee: New Nippon Electric Company, Ltd., Osaka, Japan

[21] Appl. No.: 646,957

[22] Filed: Jan. 7, 1976

[30] Foreign Application Priority Data

| | | |
|---|---|---|
| Jan. 9, 1975 | Japan | 50-5493 |
| Feb. 12, 1975 | Japan | 50-17582 |
| Jun. 24, 1975 | Japan | 50-79012 |

[51] Int. Cl.[2] ..... H05B 41/14; H05B 41/24

[52] U.S. Cl. ..... 315/289; 315/105; 315/274; 315/276; 315/283; 315/DIG. 2; 315/DIG. 7

[58] Field of Search ..... 315/101, 105, 274, 276, 315/283, 284, 289, 290, DIG. 2, DIG. 5

[56] References Cited

U.S. PATENT DOCUMENTS

| | | | |
|---|---|---|---|
| 3,466,500 | 9/1969 | Peek | 315/289 X |
| 3,699,385 | 10/1972 | Paget | 315/274 X |
| 3,866,088 | 2/1975 | Kaneda et al. | 315/105 |
| 3,919,590 | 11/1975 | Remery et al. | 315/DIG. 2 |

*Primary Examiner*—Eugene R. LaRoche
*Attorney, Agent, or Firm*—W. G. Fasse; W. W. Roberts

[57] ABSTRACT

It is the purpose of the present discharge lamp lighting system to provide reignition energy to a discharge lamp in each half cycle of the a.c. power source. The discharge lamp is connected to a conventional a.c. power source through ballast means and an oscillation booster circuit, which provides an intermittent oscillation output for the reignition operation of the discharge lamp. The operation period of the intermittent oscillation output is so controlled that the reignition operation period is included in each half cycle of the discharge lamp current. The lamp voltage and source voltage are established to agree as much as possible with each other for minimizing the terminal voltage of the ballast means, whereby a compact and economical device with a small inductance ballast means is achieved.

21 Claims, 35 Drawing Figures

ARC DISCHARGE SUSTAINING CIRCUIT SYSTEM FOR A DISCHARGE LAMP

BACKGROUND OF THE INVENTION

This invention relates to a discharge lamp lighting system which keeps the lamp lit by means of an intermittent booster which supplies reignition energy to the discharge lamp in each half cycle of an a.c. power source. The system combines a discharge lamp or lamps and a backswing booster generating an intermittent oscillation output at a given point of the lamp current and continuing for a portion of every half cycle of the power source, whereby a more economical and compact lighting device for any kind of discharge lamp is obtained.

Prior art discharge lamp lighting devices with a booster for applying a backswing voltage to start a discharge lamp are disclosed in U.S. Pat. Nos. 3,665,243; 3,753,037 and 3,866,088. Such known starter comprises mainly three oscillating circuits. A first oscillation circuit includes a power source, a linear inductor and a capacitor connected in series. A second oscillation circuit connected across the capacitor includes a saturable nonlinear inductor connected in series with a thyristor type voltage-responsive switching element. A third oscillation circuit comprises the nonlinear inductor and its distributed capacity. The discharge lamp is connected across the capacitor. The oscillation voltage generated across the capacitor for starting the discharge lamp is so high that a conventional glow starter may be substituted. The power source may be a d.c. or an a.c. source. Where the discharge lamp is of the hot cathode type which has a pair of filaments serving as discharge electrodes, the filaments are generally connected in series with the first oscillation circuit and/or with the second oscillation circuit for quickly heating the filaments. The foregoing references and remarks relate to a starter with a semiconductor.

The above references do not provide any teaching regarding a solid state lighting device. The economical aspects of compactness in structure and reliability of operation of a solid state discharge lamp lighting device are also not shown. In other words, the size of the current limiting means is essentially determined by the product VA (voltampere) of the terminal voltage (V) and the flowing current (A). Since the lamp current (A) is generally determined by the lamp type, a small size current limiting means may be used by reducing the terminal voltage (V). In conventional lighting systems, such as of the glow starter type or the previously proposed electronic starter type, the difference voltage between lamp voltage and starting voltage is indispensable for the current limiting means. Therefore, in the prior art the current limiting means cannot be reduced in size below a fixed minimum size. Adding the lead capacitor to the current limiting means does not provide a lighting device of enough compactness. Thus, the need for providing a miniaturized discharge lamp lighting device has not yet been satisfied. Though it is known to use the power factor improving impedance of a capacitor of 3.5 μF connected in parallel to the power source in a lag lighting operation of a single 40-watt discharge lamp, whereby a source voltage of 200 volts and 60 Hz is employed, the miniaturization of the device is restricted to conventional means.

OBJECTS OF THE INVENTION

In view of the foregoing, it is the aim of the present invention to achieve the following objects singly or in combination:

- to provide a discharge lamp lighting system wherein the oscillation output of a booster circuit is used to cause an ignition in each half cycle of the lamp current from an a.c. power source when the discharge lamp is lit;
- to provide a miniature or small size lighting device for discharge lamps, wherein the lamp voltage and the source voltage are substantially equal to each other due to the fact that a single special discharge lamp is used or several discharge lamps in series are used, having a total lamp voltage corresponding substantially to the source voltage, or due to the use of a special lamp voltage changing means such as a transformer for obtaining the total lamp voltage of the discharge lamp at the output terminals of the a.c. voltage source and/or due to the selection of the operating conditions;
- to reduce the required operating voltage and the volt-ampere capacities of the lamp current limiting means by using a booster output voltage not only for the starting but also for reignition in each half cycle;
- to provide a lighting device for two discharge lamps employing one intermittent oscillation booster circuit for reignition of the discharge lamps in each half cycle of the lamp current;
- to provide a discharge lamp lighting device in which a booster circuit is operated by enhancing means, such as a step-up voltage of the power source;
- to provide an improved discharge lamp lighting device using a high frequency intermittent oscillation output for both the starting and the reignition of the discharge lamp, and to employ small size current limiting means;
- to provide a lighting device for one or more discharge lamps of the preheat type, in which a filament heating circuit uses the oscillation output generated by a booster circuit for preheating the filaments prior to the discharge lamp lighting operation;
- to provide a discharge lamp lighting device which includes a series resonance circuit for the oscillation frequency to increase the oscillation output voltage whereby the frequency and/or voltage of the oscillation output in the booster circuit can be reduced in order to prevent noise generation; and
- to improve the power factor to assure a relatively small fluctuation of the lamp current and thus a stable and reliable ignition in a wide range of ambient temperatures.

SUMMARY OF THE INVENTION

In accordance with the invention there is provided a lighting system for discharge lamps, wherein a low frequency component derived from a power source and a high frequency oscillation output from a booster circuit are superimposed one on the other and supplied to the discharge lamp. The low frequency component flows through the discharge lamp during an inactive portion of each half cycle of lamp operation. The high frequency oscillation output is supplied to the discharge lamp during the leading portion of each half cycle of the low frequency component, whereby an extinction or an ion reduction within the discharge lamp during the inactive period of the low frequency component during the leading portion of each half cycle is prevented or compensated due to excitation by the high frequency component. Thus, the discharge lamp lighting conditions are sustained even if the lamp voltage corresponds substantially to the source voltage. Therefore, the lamp is immediately turned off if the high frequency alternating component is switched off.

In the present system, the ballast voltage is minimized by establishing the lamp voltage as close as possible to the source voltage. An intermittent oscillator circuit preferably one of the backswing voltage type, supplies the reignition voltage in every half cycle of the rising or leading portions of the lamp current. After reignition in each rising portion, the lamp current in the trailing portion of each half cycle is determined by the source voltage, the lamp voltage and the impedance of the ballast means. Since the trailing portion of the lamp current does not encroach on the intermittent oscillation period of the next half cycle, the energy stored in the ballast impedance is converted within the period of each half cycle.

A primary winding of a choke coil provides a current limiting means. The secondary winding of the choke coil is coupled to the booster circuit for transferring the high frequency oscillation output from the booster circuit to the discharge lamp. Where the discharge lamp is of the preheating type, heating means such as a preheating circuit or a filament transformer, is coupled for heating the filament. A step-up transformer may be used to make the lamp operation still more certain. In order to assure that the total lamp voltage of a particular discharge lamp or of a series connection of lamps corresponds substantiall to the line voltage of a power source the lamp voltage may be rated to correspond to the source voltage, or, a source voltage reducing impedance may be used, or a source voltage transformer and/or specific operating conditions may be combined in the lighting device of the present invention. Further, a resonant circuit and/or noise suppressing circuit should be included for practical purposes. However, a capacitor for improving the power factor may be eliminated or reduced at least in size, because the circuit of the present invention has inherently a high power factor. The present invention has the following advantages.

The current lighting means for stabilizing the arc discharge are substantially reduced. For instance, a calculation by means of an analog computer has shown that the theoretically necessary value of the required impedance may be reduced to about one tenth of that of a conventional ballast. This means that the energy loss in the ballast is substantially decreased. As a result, the efficiency of the present lighting system is also substantially improved by reducing the power loss encountered heretofore. Compared to a conventional lighting device in which the lamp voltage is generally set at about one half of the source voltage, the present invention provides an improved efficiency of about 25% in lumens per watt. This improved efficiency saves a substantial amount of energy in the discharge lamp lighting field.

Another advantage of the present system is seen in that the lamp current fluctuation is kept small and stable in spite of the use of a small impedance ballast. Furthermore, the invention achieves a stable lamp operation over a relatively wide range of ambient temperatures. Thus, the present device may be used, for instance at high temperature.

Still another advantage is seen in that the capacitor for improving the power factor may be eliminated, because the present system provides inherently a high power factor operation. A fourth advantage resides in the fact that the noise generation of the lighting system of the present invention is inherently at a lower level than that of a conventional lighting system using high frequency oscillation. The low noise generation according to the invention is due to the use of an intermittent oscillation or stated differently, due to the short operation period of the booster circuit. The use of a resonance circuit and/or noise prevention circuit is also useful for the reduction of noise and the core of the choke coil should be grounded.

The foregoing merits are achieved by the invention in a system comprising a choke coil having primary and secondary windings, and a booster circuit including a backswing voltage oscillation circuit and a second capacitor for intermittent oscillation. The backswing voltage oscillation circuit comprises a first oscillation capacitor and a series circuit of a nonlinear inductor and a switching semiconductor as disclosed in the U.S. Patents mentioned above. The booster circuit generates a high frequency intermittent oscillation output during the lamp operation and serves to start and reignite the discharge lamp in each half cycle of the lamp current. The oscillation output is transferred to the discharge lamp by coupling means, specifically the secondary winding of the choke coil, while the primary winding of the choke coil stabilizes the discharge current of the discharge lamp. The above booster circuit may be replaced by other types of oscillators, such as a high voltage generating circuit for a pulse generator, or an inverter device for generating the intermittent oscillation output.

The present circuit may be further improved by means suitable for boosting of the series resonance circuit to improve the ignition for a particular type of discharge lamp, such as a high output lamp, or to reduce the frequency and/or voltage of the oscillation output. The present device is also utilized to heat the filaments of a hot cathode discharge lamp prior to ignition. For this purpose, a filament winding or an electronic filament preheating circuit is included. Preferably, a lighting device for one or more discharge lamps includes in combination at least one filament winding for an intermittent or continuous oscillation output from the booster circuit and/or a series resonance circuit with a capacitor connected across the discharge lamp and an inductor connected in series therewith. The heating of the filaments by the intermittent or continuous oscillation output during the time when the discharge lamp is not lit, also contributes to reducing the size and the cost of the lighting device.

BRIEF FIGURE DESCRIPTION

In order that the invention may be clearly understood, it will now be described by way of example, with reference to the accompanying drawings, wherein.

Figure 5:
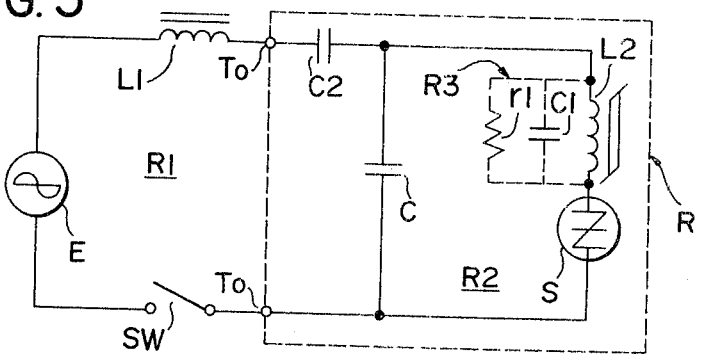
FIG. 5 is a circuit diagram of a modification of FIG. 1 in which a high output voltage with an intermittent oscillation is generated, wherein a circuit arrangement having a relatively small volt-ampere capacity is employed as a booster circuit in a discharge lamp lighting device of the present invention.
Figure 7A:
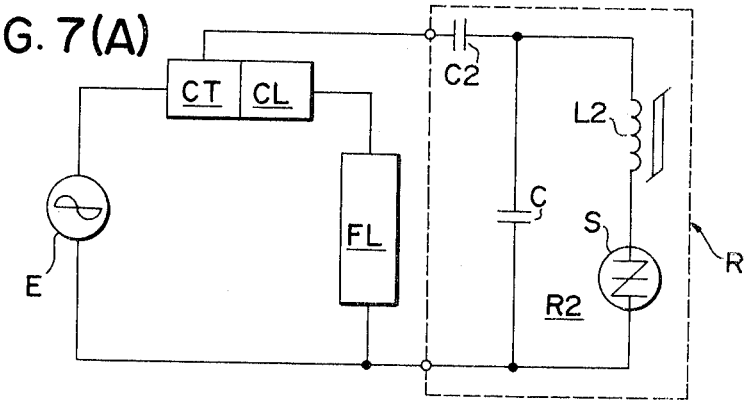
Figure 8:
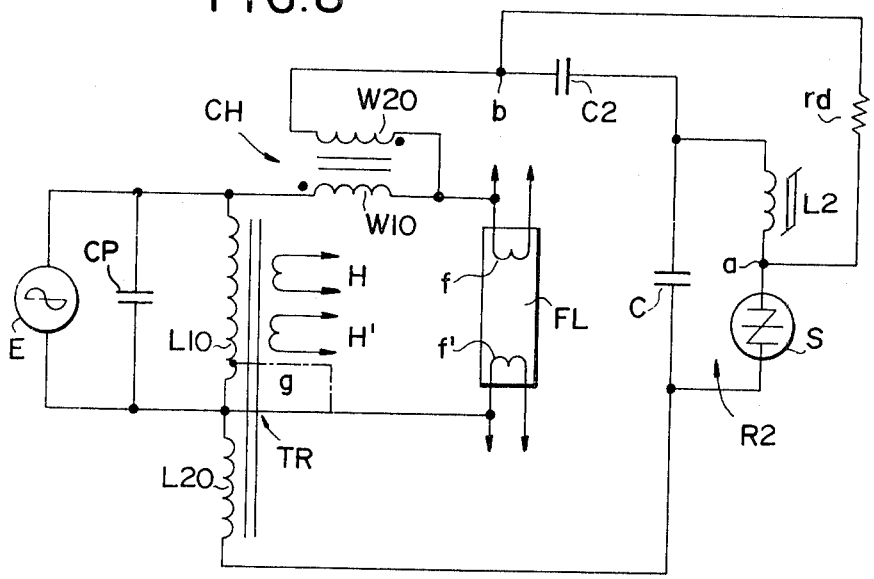
Figure 9A:
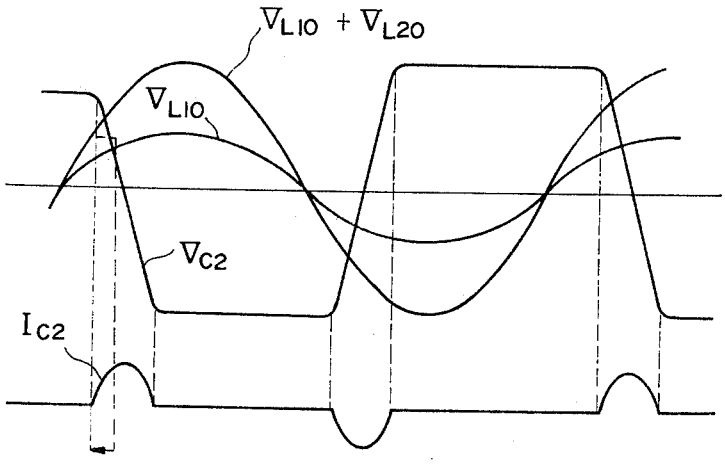
Figure 9B:
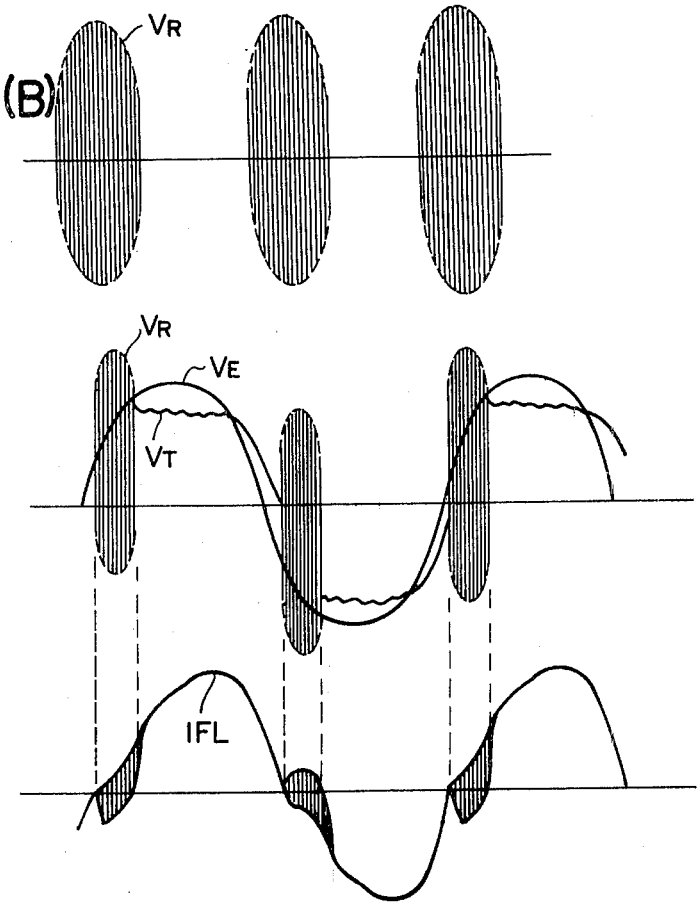
Figure 9C:
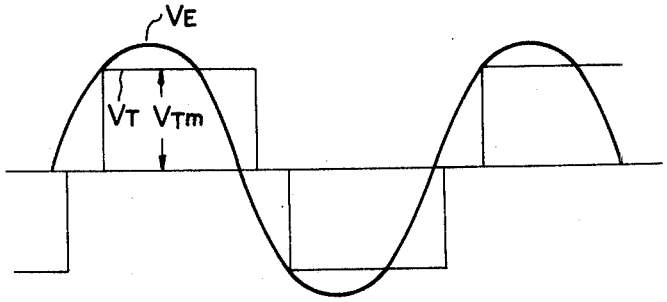
Figure 10:
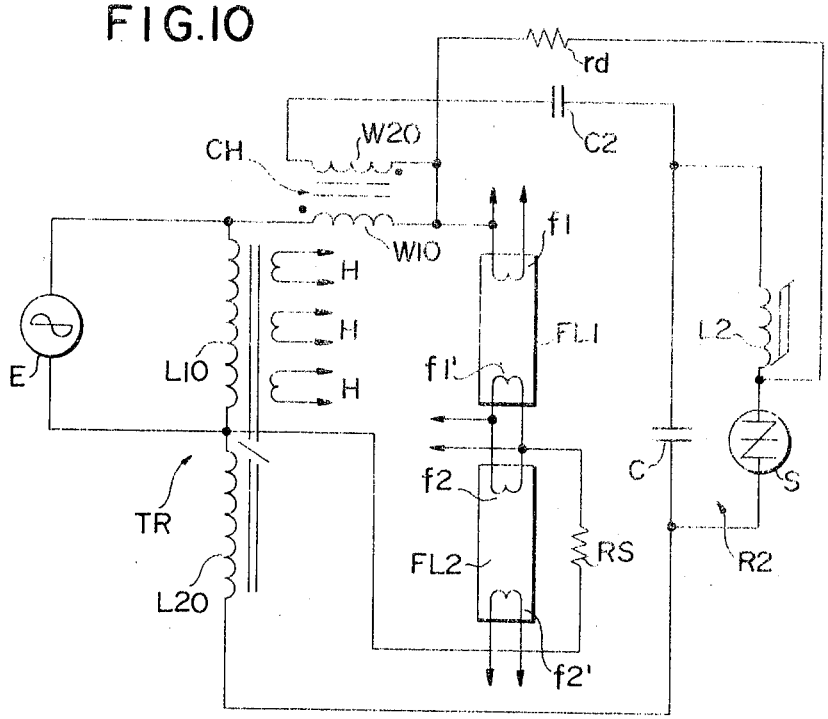
Figure 11:
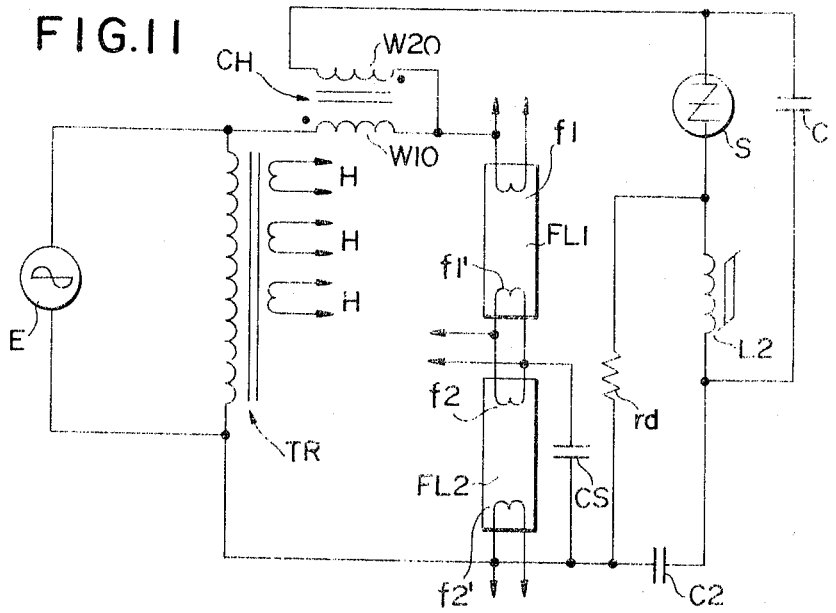
Figure 12:
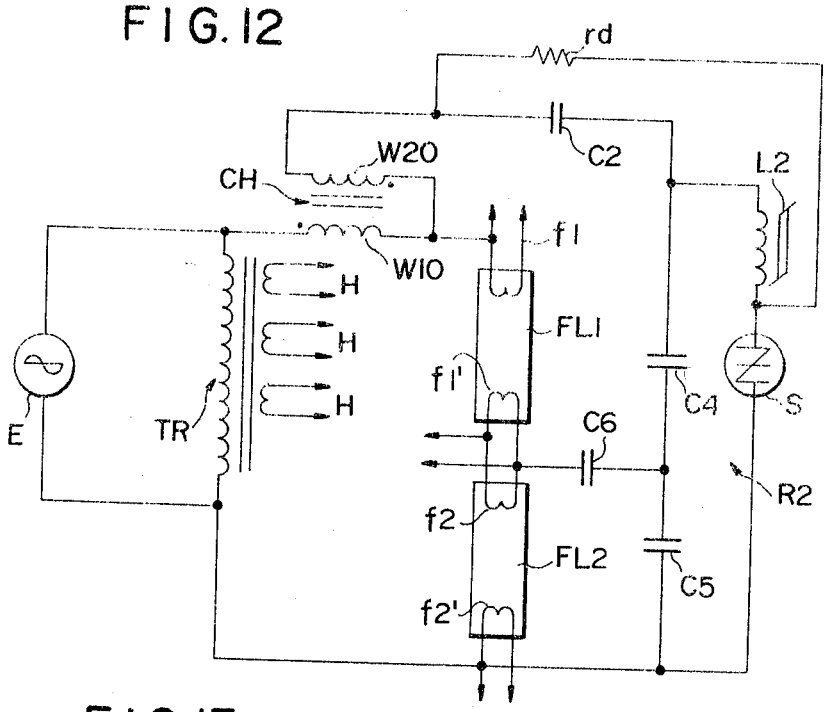
Figure 13:
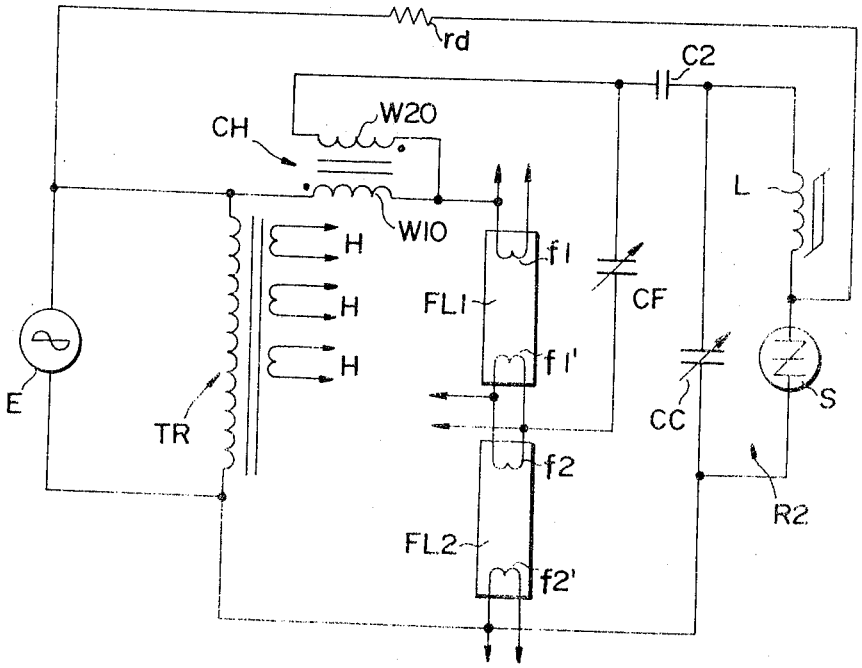
Figure 14:
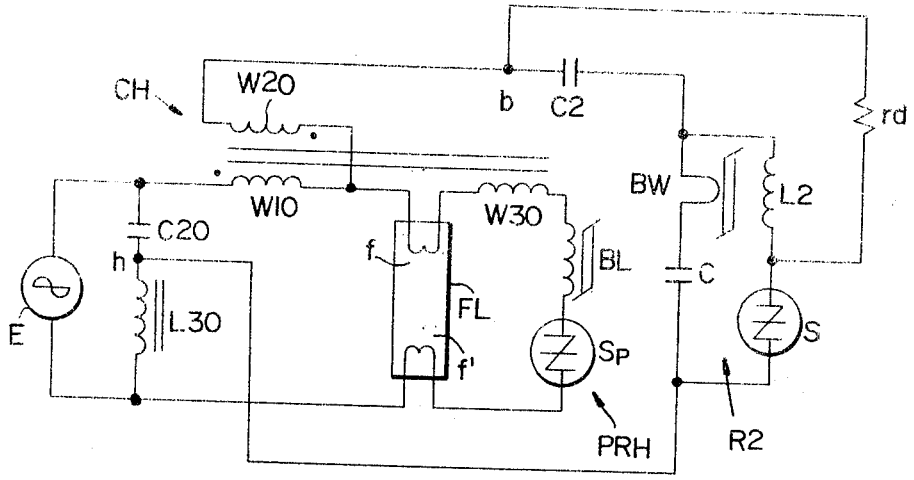
Figure 15:
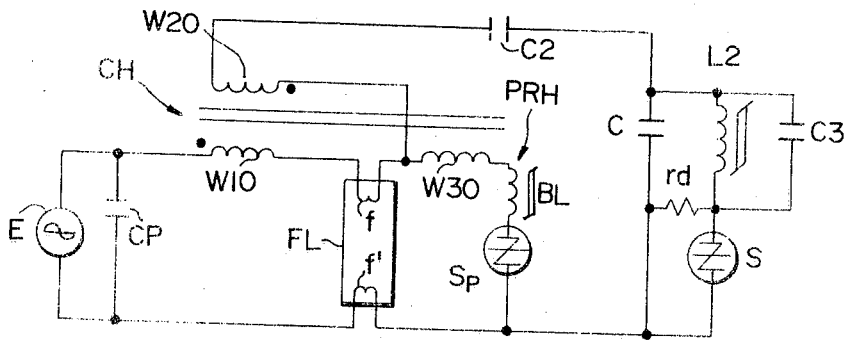
Figure 16:
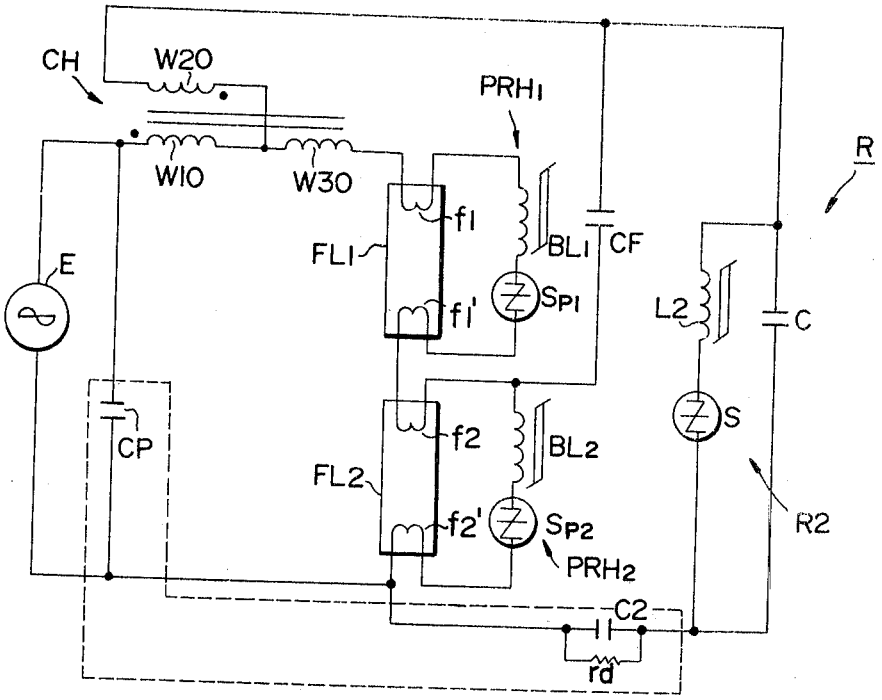
Figure 17:
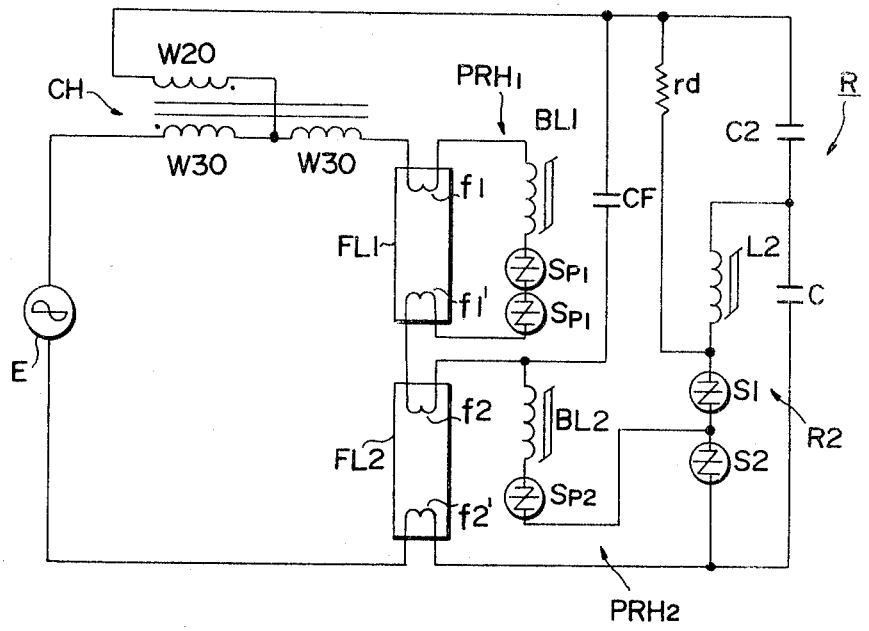
Figure 18:
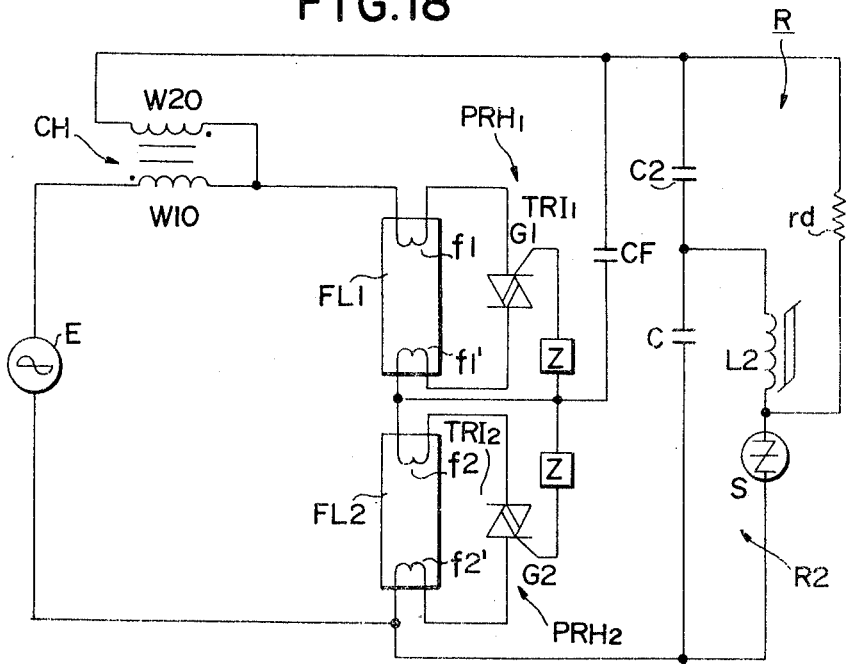
Figure 19:
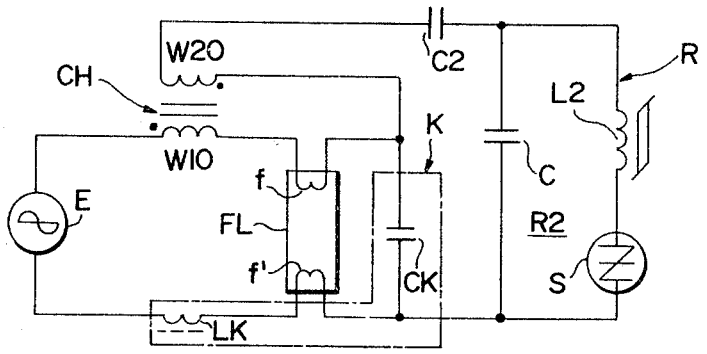
Figure 20:
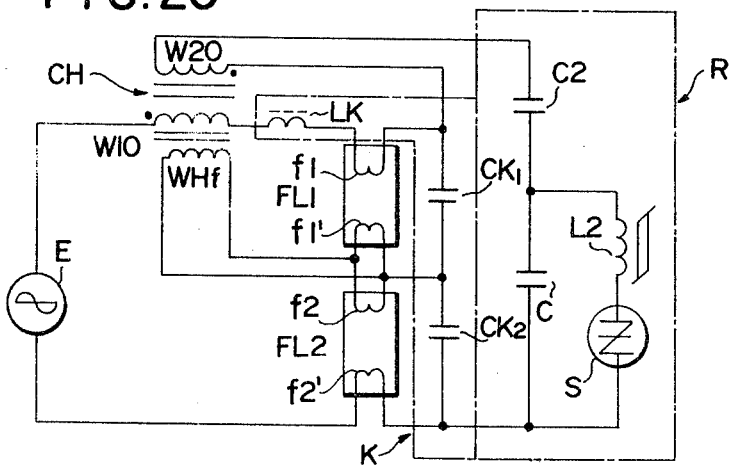
Figure 21:
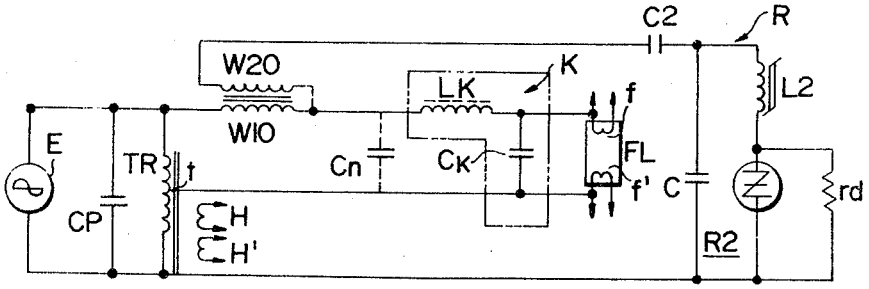
Figure 22:
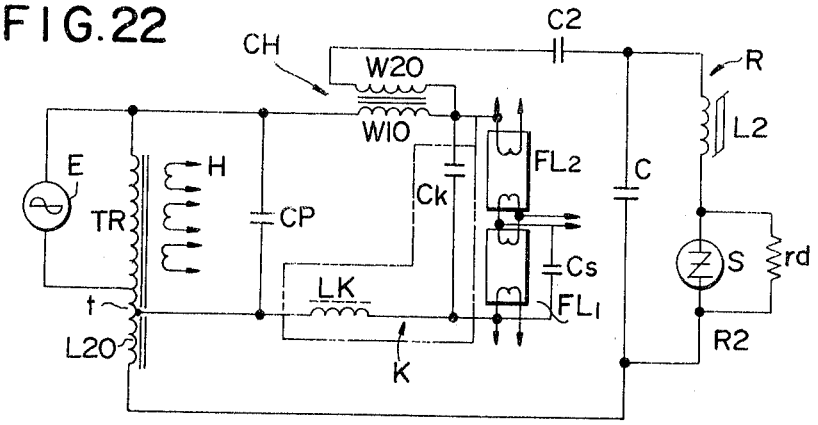
Figure 23:
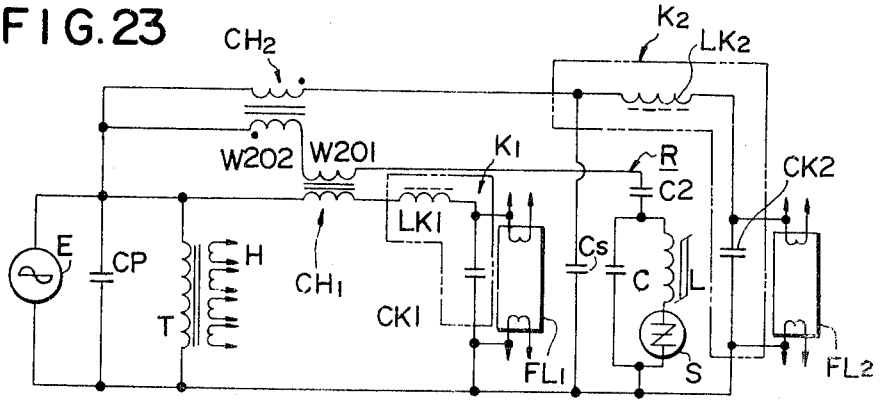
Figure 24:
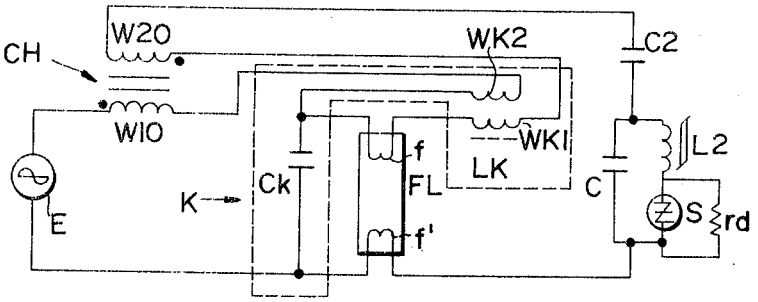
Figure 25:
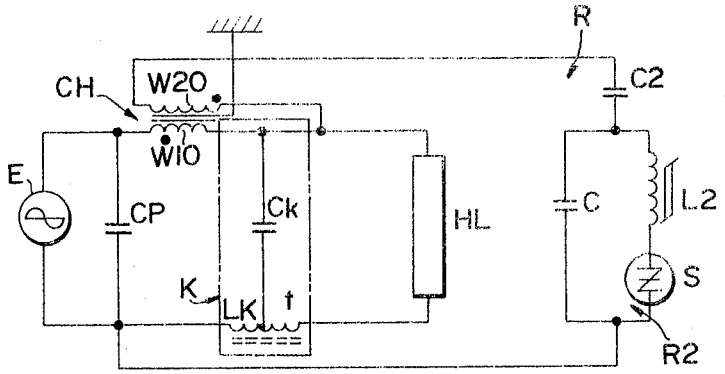
Figure 26:
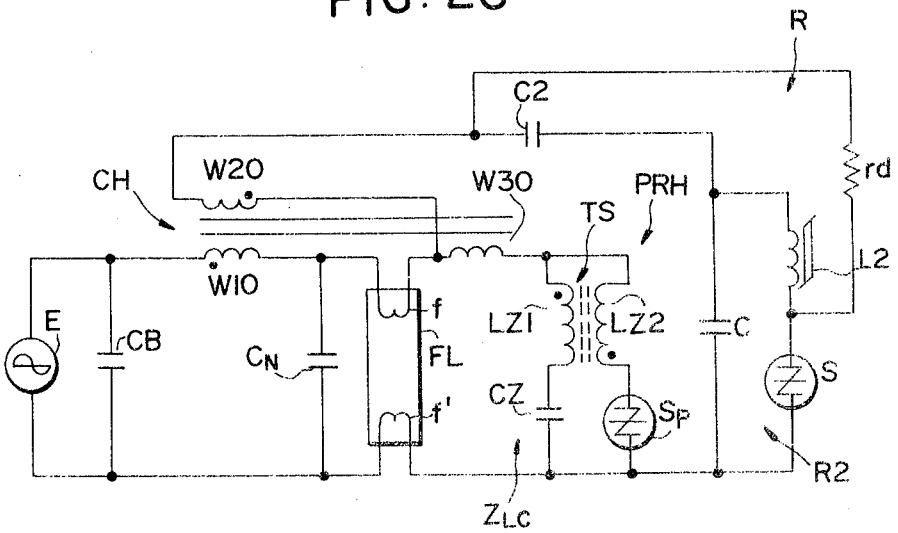
Figure 27:
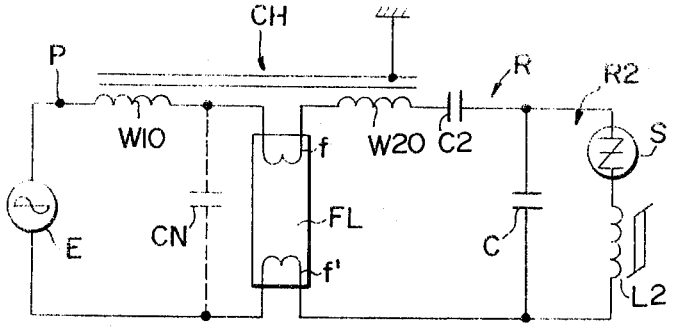
Figure 28:
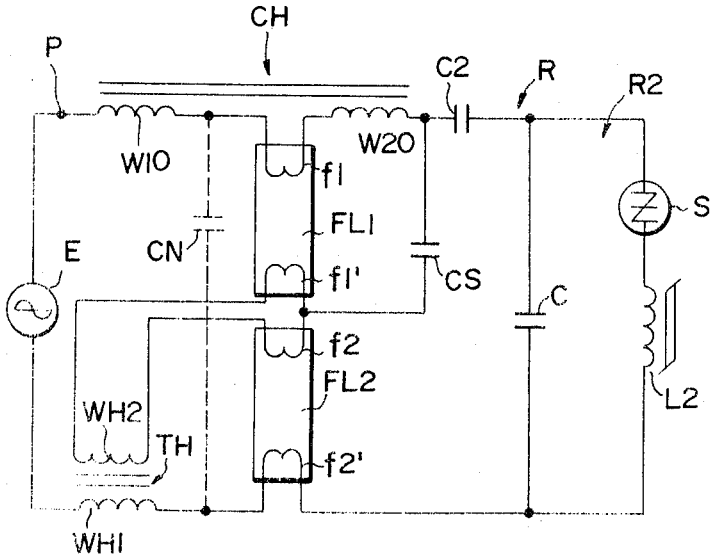
Figure 29:
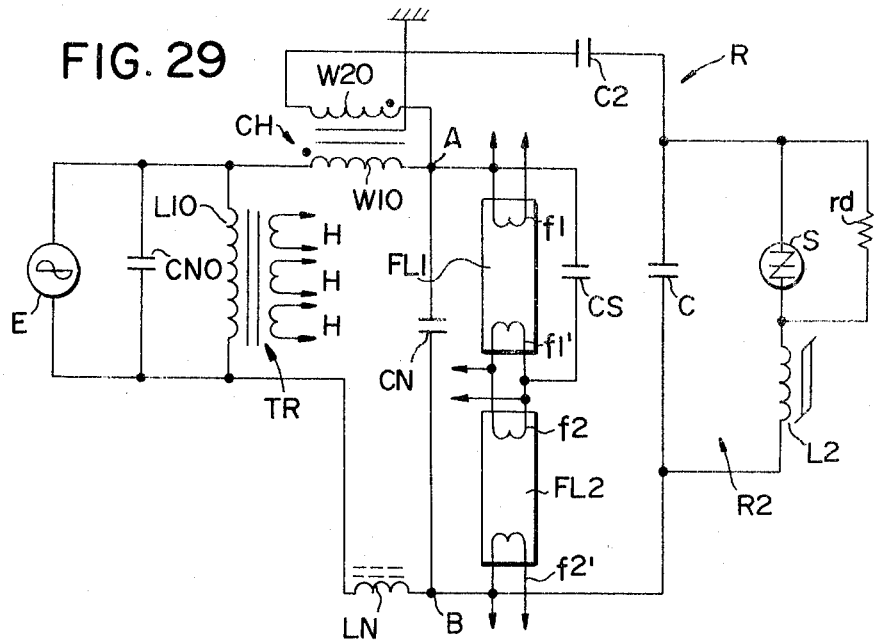
Figure 30:
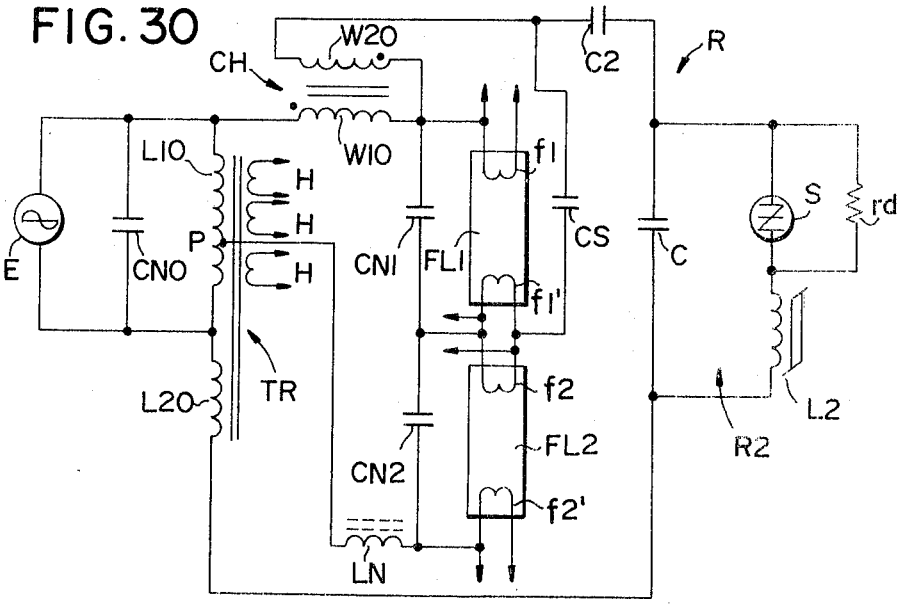

FIGS. 7(A) (B) & (C) are fundamental block diagrams of a lighting device using the booster circuit of FIG. 5 and modifications thereof in accordance with the present invention;

FIG. 8 is a circuit diagram illustrating an embodiment of a lighting device for a discharge lamp, in which a supplemental winding of a transporter which produces a step-up voltage is included to facilitate or advance the initial starting of the oscillation, whereby a voltage source is provided which facilitates the operation;

FIGS. 9(A) (B) & (C) are graphs illustrating the operation of the lighting device of the present invention, in which FIG. 9(A) shows the effect of the step-up voltage of FIG. 8, FIG. 9(B) shows the relationship of the source voltage, the intermittent oscillation voltage, the lamp voltage, and the lamp current, and FIG. 9(C) shows the simplified relationship between the source voltage and lamp voltage;

FIG. 10 is a circuit diagram of a modification of FIG. 8, in which a lighting device for two discharge lamps employs a single choke coil and a single booster circuit;

FIG. 11 is a circuit diagram of a modification of FIG. 10, in which a 200 volts source voltage is applied by the power source, and wherein a capacitor CS for sequential operation acts to advance the standing portion of the lamp current;

FIG. 12 is a circuit diagram of a modification of FIG. 11, in which the capacitor for sequential operation is also partially the capacitor of the oscillation circuit;

FIG. 13 is a circuit diagram of another modification of FIG. 11, in which a variable capacitor is used for transferring the high frequency oscillation output to the discharge lamp;

FIG. 14 is a circuit diagram of another embodiment of the invention illustrating a lighting device for a discharge lamp of the preheating type, in which an electronic filament preheating circuit heats the filaments, to eliminate the heating loss in the filaments when the lamp is lit;

FIG. 15 is a circuit diagram of a modification of FIG. 14;

FIG. 16 is a circuit diagram of a modification of FIG. 15, in which a lighting device for two discharge lamps is provided for a sequential operation system;

FIG. 17 is a circuit diagram of a modification of FIG. 16, in which 100-volts thyristors are employed for a 200-volts power source;

FIG. 18 is a circuit diagram of a modification of FIG. 16, in which the filament preheating circuit employs bidirectional triode thyristors, so called triode a.c. switches;

FIG. 19 is a circuit diagram of a further embodiment of the invention showing a lighting device for a discharge lamp, in which a resonance circuit is added to produce an amplified intermittent oscillation voltage for the ignition of the discharge lamp, and wherein an improved heating circuit is used having a high frequency heating winding in the choke coil to supply an oscillation output for starting the discharge lamp;

FIG. 20 is a circuit diagram of still another embodiment, in which a lighting device for two discharge lamps comprises a sequential operating system;

FIG. 21 is a circuit diagram of a modification of FIG. 19, wherein the filaments of the discharge lamp are heated by a transformer;

FIG. 22 is a circuit diagram of a modification of FIG. 21, in which two discharge lamps are connected in the sequential operating system;

FIG. 23 is a circuit diagram of another modification of FIG. 21, in which each of the two discharge lamps is connected in parallel with the power source through respective choke coils and resonance circuits;

FIG. 24 is a circuit diagram of another modification of FIG. 19, in which an inductor for the resonance circuit comprises two windings;

FIG. 25 is a circuit diagram of a further modification of FIG. 19, in which a lighting device for a cold cathode type discharge lamp includes a resonance circuit;

FIG. 26 is a circuit diagram of still another embodiment, in which an erroneous operation of the filament preheating circuit is prevented by cancelling the oscillation;

FIG. 27 is a circuit diagram of still another modification of FIG. 19, in which the input current for the booster circuit is used for preheating the filaments;

FIG. 28 is a circuit diagram of a modification of FIG. 27, in which two discharge lamps are employed;

FIG. 29 is a circuit diagram of a further embodiment, in which a noise preventing capacitor is used; and FIG. 30 is a circuit diagram of a modification of FIG. 29.

DETAILED DESCRIPTION OF PREFERRED EXAMPLE EMBODIMENTS

Figure 1:
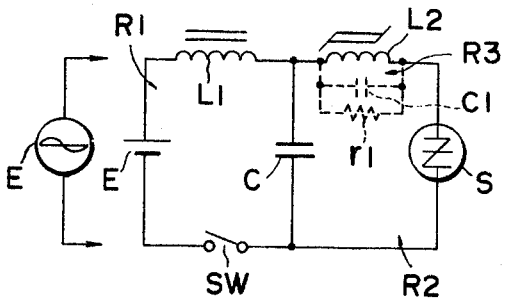
FIG. 1 is a circuit diagram of a basic oscillation circuit which may be employed in a discharge lamp lighting device of the present invention.

FIG. 1 shows a circuit diagram of the basic oscillator which is also employed in the present invention as the backswing booster. A first oscillation circuit R1 comprises a power source E, a linear inductor L1 such as a choke coil, an oscillating capacitor C and a power switch SW connected in series with the power source E. A second oscillation circuit R2 is formed of a series circuit which comprises a saturable nonlinear inductor L2 and a bidirectional two terminal switching element S operative in response to a voltage, and connected in parallel with the capacitor C. A third oscillation circuit R3 comprises an inductor L2 and a capacitance element such as its distributed capacity C1. The inductor L2 has such characteristics that its inductance decreases with an increase of the current flowing therethrough, and that it is magnetically saturated when the magnetic flux through the core exceeds a certain value. These characteristics are attainable by a closed magnetic path using a core of magnetic material, such as Mn-Zn type ferrite which is also dielectric. In this circuit arrangement, the first oscillation circuit is called a power source circuit, and the second and third oscillation circuits are called high voltage generating circuits.

Figure 2:
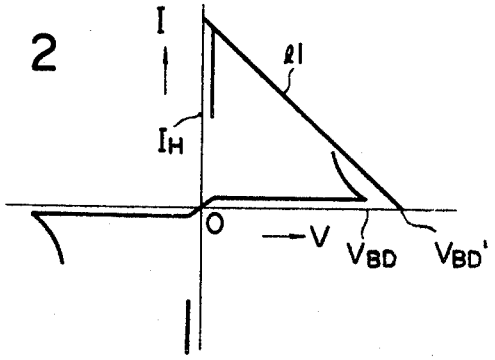
FIG. 2 is a graph of a voltage response characteristic of the switching semiconductor in the oscillation circuit of FIG. 1.

FIG. 2 shows a voltage current characteristic of a typical bidirectional two terminal switching semiconductor S, such as a thyristor, advantageously used in the oscillator of FIG. 1. These characteristics and respective semiconductors are well known to those skilled in the art. The oscillation period of the second oscillation circuit or high voltage generating circuit R2 is chosen to be smaller than that of the first oscillation circuit R1 at the moment of saturation of the inductor L2. The distributed capacity C1 of the inductor L2 is shown in FIG. 1 as an equivalent connected in parallel with the inductor L2. The equivalent loss resistance r1 of the inductor L2 is also connected in parallel with the inductor L2. For an optimum operation of the backswing booster it has been found, according to the invention, to be useful to connect a small capacitor in parallel with the inductor L2.

Figure 3A:
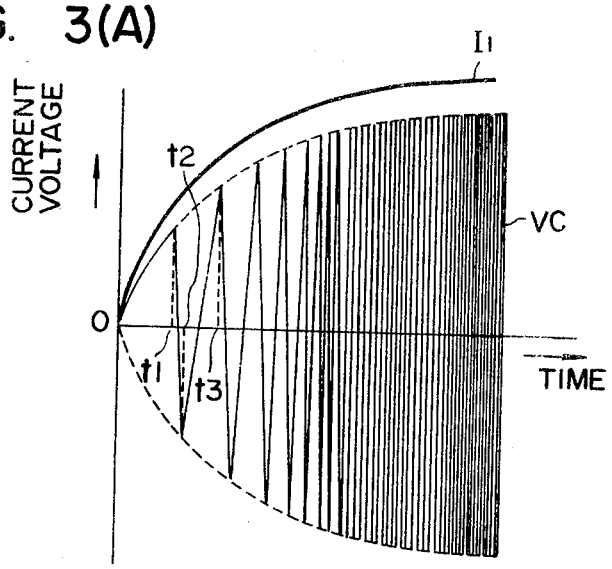
FIGS. 3(A) and (B) are graphs illustrating the operation of the oscillation circuit of FIG. 1.
Figure 3B:
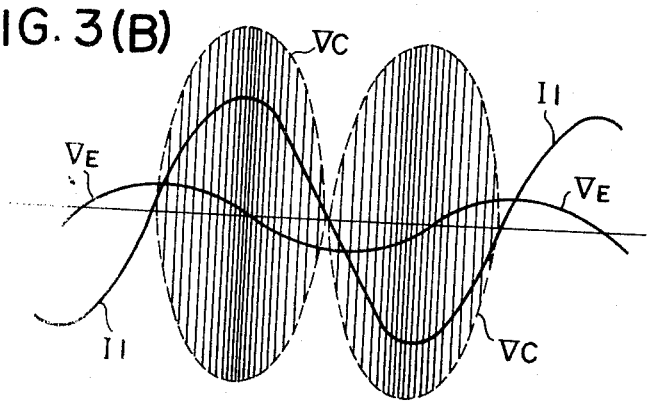

FIG. 3 (A) shows the voltage VC generated by the circuit R2 between both ends of the capacitor C in case where a direct current (d.c.) power source E is employed as the power source. FIG. 3 (B) shows the similar voltage VC but with an alternating current (a.c.) power source.

Figure 4:
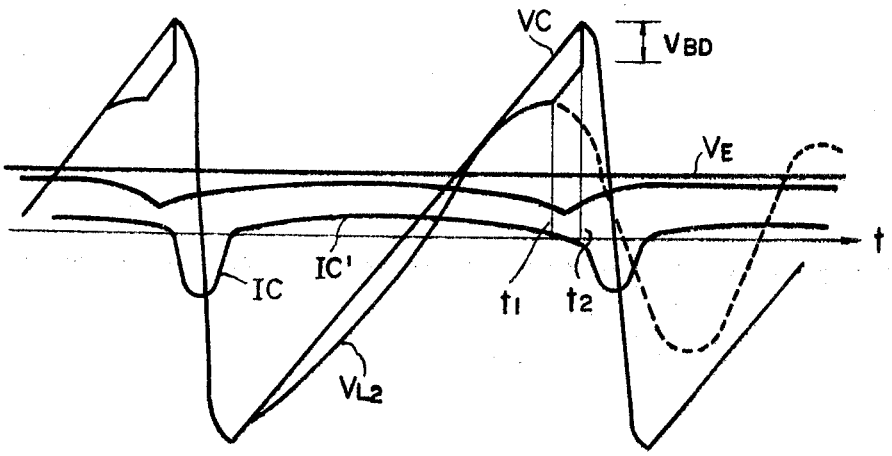
FIG. 4 is a timing diagram illustrating the operation of the oscillation circuit.

FIG. 4 shows the relationship of the voltage VC across the capacitor C, the current IC through the capacitor C, the output voltage Ve from the (d.c.) voltage source E and the backswing voltage VL2 across the inductor L2 on an enlarged scale along the time axis when the oscillation has been stabilized.

Referring now to these figures, an initial sequence in the operation of the apparatus is a charging mode of operation, in which the switch SW is closed to charge the capacitor C whereby the voltage VC across the capacitor C applied to the switching semiconductor S through the inductor L2 increases.

When the voltage VC has exceeded the breakdown voltage VBO of the switching semiconductor S (as at the time t1 in FIG. 3 (A)), the switching semiconductor S is turned on and the capacitor C is discharged since the inductor L2 practically does not have any substantial impedance for such a low frequency voltage variation. In this way, a discharge mode of operation begins. The discharge current IC through the capacitor C increases in a cosine wave pattern with respect to the decrease of the voltage C, i.e., in a sine wave pattern advanced by about $\pi/2$, and then starts decreasing, see FIG. 4. The current IC reaches a very high level due to the saturation of the inductor L2 when the quality factor Q of the second oscillation or high voltage generating circuit R2 is high. The inductance 1s of the inductor L2 is extremely small when L2 is saturated, as compared to the inductance 1u at a moment of non-saturation. The current IC decreases with the progress of the discharge of the capacitor C and thus the current I2 through the switching semiconductor S decreases. Thus, the current I2 represents the sum of the discharge current IC from the capacitor C and the current I1 through the switching semiconductor S when the switching semiconductor S is turned on. The current I1 is supplied from the power source E through the path E-L1-L2-S-E. The current I1 in an early stage increases very slowly because of the large inductance of the linear inductor L1 and is small enough to be neglected. Hence, the switching element S is turned off when the current I2 has decreased to the holding current IH of the switching semiconductor S (as at the time t2 in FIG. 3(A)). While the switching semiconductor S is kept on, the electric charge of the capacitor C is transferred and thus the voltage VC is inverted in porality to become slightly higher than −VBO because the voltage drop caused by the resistance r1. This, however, does not mean that the switching element S is immediately turned off in an opposite direction. Since, when the switching semiconductor S is on, the capacitor C and the distributed capacity C1 is at the same time charged to the same voltage in the same polarity as the capacitor C, its voltage thus being about −VBO. Thus, the inductor L2 is restored to be in the unsaturated condition when the switching semiconductor S is turned off or blocked.

With the switching semiconductor S off, a new charging mode of operation begins in the first oscillation circuit R1. The initial value of a primary current I3 flowing through the inductor L1 cannot be zero in this mode of operation, which is different from the initial charging mode of operation, since the initial value of the primary current I3 is still present immediately before the electromagnetic energy stored in the inductor L1, turns off the switching semiconductor S in the previous discharging mode of operation. In addition, the normal current I4 having the same value as in the initial charging mode of operation flows to charge the capacitor C. As a result, the current I1 for charging the capacitor C is the sum of both the primary current I3 and the normal current I4. The oscillating operation of the inductor L1 and the capacitor C causes the capacitor C to be charged again, and thus the voltage VC continues increasing from −VBO through zero to and above +VBO. Meanwhile, the switching semiconductor S is kept nonconductive even if VC has increased above +VBO because during the previous discharging operation electrostatic energy is stored in the distributed capacity C1 of the inductor L2. More specifically, even after the switching semiconductor S is turned off and thus the current I2 through the switching semiconductor S is cut off and the inductor L2 is again in the non-saturated condition, the electrostatic energy stored in the distributed capacity C1 is transferred so that the backswing voltage VL2 as shown in FIG. 4 is generated across the inductor L2 in a direction opposite to that of the voltage VC across the capacitor C. Thus, a damped oscillation is started which is caused by the inductance 1u in the non-saturating condition of the inductor L2 and the distributed capacity C1. Consequently, the terminal voltage of the inductor L2 remains as it is for a relatively long time period which is longer than the time period of t2 to t3 as shown in FIG. 3 (A).

The direction of the discharge current IC′ from the distributed capacity C1 is opposite to that of the discharge current IC of the capacitor C with respect to the inductor L2, and hence the inductor L2 is quickly restored to the unsaturated condition. By proper choice of the construction of the inductor L2, it is possible through adjustment of the oscillating operation caused by the inductor L1 and the capacitor C in the first oscillation circuit R1, to make the variation rate of the backswing voltage VL2 similar to that of the terminal voltage VC caused by recharging of the capacitor C. In such a case, the terminal voltage across the switching semiconductor S determined by the difference between the voltage VC and the voltage VL2, is kept low for a considerably long time despite the rise of the terminal voltage VC of the capacitor C. While the backswing voltage VL2 attenuates in a damped oscillation, as mentioned above, and as a result a difference voltage between the terminal voltage VC of the capacitor C and the backswing voltage VL2 continues increasing gradually until the difference voltage is equal to VBO and at this moment the switching semiconductor S is turned on again. Thus, the charging and discharging modes of operation are alternately repeated.

As a result, each time the capacitor C is charged the normal capacitor charging current I4 is added to the primary current I3 through the first oscillation circuit R1, and each time the capacitor C is discharged the primary current I3 passing through the loop E-L1-L2-S-E continues increasing gradually, whereby the capacitor charging current I1 also continues increasing gradually, so that the time period of the charging mode of operation is shortened as the charging is repeated.

Meanwhile, as mentioned above, the primary current I3 flowing through the loop E-L1-L2-S-E continues increasing in each discharging mode, and the terminal voltage VC of the capacitor C increases immediately before the switching semiconductor S is turned on. Consequently, the current I2 through the inductor L2 increases gradually. As a result, the amount of electrostatic energy stored in the distributed capacity C1 increases and thus the backswing voltage VL2 across the inductor L2, which is generated by the oscillation circuit R3 when the switching semiconductor S is turned off, also increases.

Thus, the voltage VC is amplified in the charging mode and inverted in discharging mode. The backswing voltage VL2 is amplified in the discharging mode. Hence VC gradually increases thus VC = VBO + VL2 until eventually the voltage VL2 can follow the voltage VC at its extreme. In this stabilized condition, the primary current I3 remains constant, and is only slightly lower than the current I1 stabilized in the circuit shown in FIG. 1 with the capacitor C eliminated and the switching semiconductor S short-circuited. The oscillation period is determined by the voltage VC under this stabilized condition.

In this way, the modes of operation described above are repeated and the circuit shown in FIG. 1 oscillates to provide an alternating current a.c. output, as illustrated in FIG. 3 (A). Eventually, the oscillation output voltage VC follows such a pattern that the envelope saturates at a value determined by the circuit constants. Thus, an a.c. voltage VC of high frequency is generated across the capacitor C, which is higher than that of the d.c. voltage source E. The oscillation frequency attainable in the embodiment of the invention is up to several tens KHz and the oscillation voltage is up to nearly 10 times the source voltage and the oscillation current I2 is up to two or three times the current I1.

It is to be understood that an a.c. power source may be used as the power source E in view of the high oscillation frequency. It such a case, as seen from FIG. 3 (B), the envelope of the oscillating output voltage VC follows a sine curve which is in phase with the a.c. input current I1, and is out of phase by about 80° with an a.c. voltage VE of the a.c. power source E, and is substantially symmetrical with respect to the time axis. The above function is achieved also in case where a capacitor is connected in series with the linear inductor L1 and thus the series capacitor C and the linear inductor L1 cooperate as a so called advanced-phase current limiting circuit.

Figure 6:
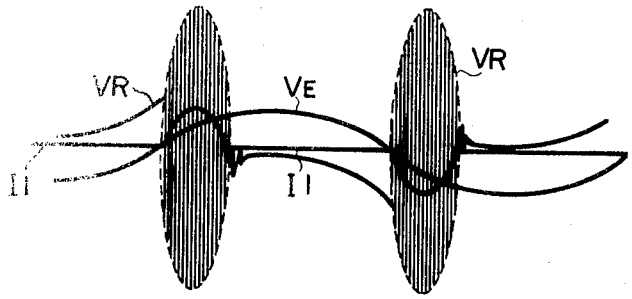
FIG. 6 is a graph illustrating the operation of the booster circuit of FIG. 5.

FIG. 5 shows a modification of FIG. 1, in which high frequency and high voltage is generated by intermittent oscillation from the output terminals To of the high voltage generating circuit. FIG. 6 shows the voltage VR generated by the circuit R of FIG. 5, in which an impedance circuit having a capacitor C2 for limiting the current is added to the high voltage generating circuit R2, for instance, between the capacitor C and the linear inductor L1. In this case, since the input current I1 flows intermittently as shown in FIG. 6, a momentary high voltage output may be obtained by a small current from the circuit R2 providing a reduced volt-ampere capacity.

This intermittent oscillation appears at the output terminals To. When the switching semiconductor S turns on by applying different voltages between the source voltage VE and the voltage VC2 across the second capacitor C2, the voltage VC2 is rapidly reversed to −VC2 and remains as it is for a half cycle. Since the switching semiconductor S turns off in VE−VC2 < VBO during the next half cycle, the source voltage VE is offset as −VC. For obtaining the same effects, the capacitor C2 in the impedance circuit is also connected in series with the thyristor S and the nonlinear inductor L2 in the second oscillation or high voltage generating circuit R2.

In the discharge lamp lighting system of the present invention it is preferred to utilize the high voltage, high frequency and intermittent oscillation output VR generated across the output terminals To in the series circuit of the capacitor C2 and oscillation circuit R2 shown in FIG. 5, which is referred to hereinafter as a "backswing booster".

In accordance with this invention, the backswing booster as shown in FIG. 5 is employed in combination with controlling means for the oscillation output as part of the lamp operating circuit arrangement. In a discharge lamp lighting system of the present invention, the output of the backswing booster starts and reignites the discharge lamp in each half cycle of the power source, whereby the terminal voltage of the ballast of the current limiting means is maintained as low as possible and the voltage VE of the a.c. power source is kept close to the lamp voltage VT across the discharge lamp.

Figure 7B:
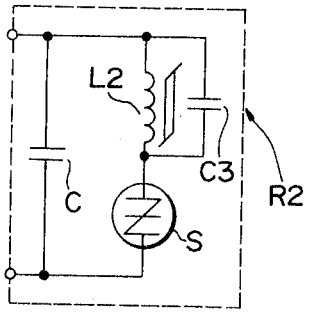
Figure 7C:
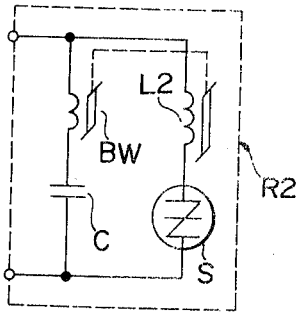

FIG. 7 (A) shows a basic block diagram of a circuit arrangement for lighting one or more series connected discharge lamps FL in accordance with the present invention. The discharge lamp FL is connected across the a.c. power source E, through a current limiting means CL and the booster circuit R is coupled by coupling means CT with the discharge lamp in order to establish the start and reignition operation of the discharge lamp from a low frequency a.c. power supply source. The essential feature of the backswing booster circuit R are the same as those of the circuit shown in FIG. 5, and therefore like parts are designated by like reference characters. For the purpose of simplicity, the distributed capacity C1 and the equivalent loss resistance r1 of the nonlinear inductor L2 in the third oscillation circuit R3 are omitted from the figures to be described below.

The oscillation circuit R2 as shown in FIG. 7 (A) may be modified as shown in FIG. 7 (B) wherein a small capacitor C3 is connected across the nonlinear inductor L2 to obtain the optimum condition for the third oscillation circuit R3 and to generate the output voltage efficiently. The capacitance of C3 may be chosen to increase the amplitude of the backswing voltage VL2 as shown in FIG. 4. The oscillation circuit R2 may be further modified as shown in FIG. 7 (C), wherein a bias winding BW connected in series with the capacitor C is added to the oscillation circuit R2 to obtain the increased or decreased oscillation output depending on the coupling manner of the bias winding BW, namely in the magnetizing or de-magnetizing direction. Further, the discharge lamp FL in FIG. 7 (A) may be either of the hot cathode type or of the cold cathode type. In FIG. 7 (A), the filament heating means are shown, which are not required for a cold cathode discharge lamp such as low or high pressure sodium lamps, metal halide lamps or mercury lamps.

Since the booster circuit R comprises the oscillation circuit R2 and the capacitor C2 for intermittent oscillation, the phase control of the intermittent oscillation to each half cycle of the power source E is achieved by the capacitor C2. Coupling means CT transfer the oscillation output to the discharge lamp FL. The high voltage oscillation starts or turns on the discharge lamp. When the discharge lamp FL is lit, a ballast or current limiting means CL including the linear inductor L1 acts as a current limiter while the capacitor C2 serves as a phase controller of the intermittent oscillation for reignition in each half cycle of the lamp current.

In the device of FIG. 7 (A), the voltage across the ballast or current limiting means CL is maintained as low as possible whereby the differential voltage between the source voltage VE of the power source E and the lamp voltage VT of the discharge lamp FL is kept near zero. If VE is 100 volts, VT is 100 volts, and FL is a fluorescent lamp of a 40-watt preheated filament type lamp, the terminal voltage VCL of the ballast may be maintained at about 30 volts due to the difference in the waveforms between the lamp voltage and the source voltage. It is the aim of the present invention to provide a low terminal voltage across the ballast or current limiter CL, whereby a small size or miniature ballast may be used. This is achieved by using the intermittent oscillation output for both the starting and the reignition of the discharge lamp so as to make the voltage VE of the power source E substantially equal to the lamp voltage VT of the discharge lamp. However, it is noted that the continuous oscillation output may be used for the starting of the discharge lamp.

As has been explained above, it is the purpose of the present invention that the lamp voltage and the source voltage are established to agree as much as possible with each other for minimizing the terminal voltage of the ballast means. Thus, the lamp voltage of a single discharge lamp or the total lamp voltage of two or more series connected discharge lamps should correspond to the rated line voltage. Depending on the type of power distribution system, the rated line voltage may differ from country to country. Thus, in Japan, for example, the rated line voltage is 100 and 200 volts, whereas in the United States it may be 117 and 237 volts. On the other hand, the rated lamp voltage of the discharge lamps depends on the type of lamp used. For instance, a 40 watt fluorescent lamp of the type 40T12 has a rated lamp voltage of 104 volts at an operating current of 435 milliamperes. Another fluorescent lamp of the type 110T12 has a 110 watt rating with a lamp voltage of 160 volts. Accordingly, the lamp voltages of prior art discharge lamps differ from the rated line voltages of the available power source except, for instance where a 40 watt fluorescent lamp is operated by the 100 volt line voltage in Japan. Thus, in order to accomplish the teachings of the invention, the lamp voltage of a single discharge lamp should be selected to correspond substantially to the rated line voltage. Similarly, where two or more discharge lamps are connected in series, the total lamp voltage should also correspond to the rated line voltage. For example, where two lamps are connected in series, each should have a lamp voltage corresponding to one half of the rated line voltage. As an alternative, a voltage transformer or an impedance may be used to obtain a total lamp voltage corresponding to the line voltage. In a third possibility the lamp operating conditions may be selected so that the total lamp voltage corresponds to the rated line voltage. The lamp voltage, as is well known, varies as a result of the lamp operating current. For instance, when a 110 watt fluorescent lamp having a rate lamp voltage of 160 volts is operated at 200 volts line voltage. The operating condition should be selected so that the lamp operates at 45 watts of the rated total 110 watts because the lamp voltage at the 85 watt lamp operation corresponds to about 200 volts.

According to a new and improved discharge lamp lighting system of the present invention, both the starting and the reignition voltages are obtained from a high frequency intermittent oscillation output which is generated in the booster circuit R. When the ballast terminal voltage is significantly reduced while the lamp current is kept constant, the magnetic flux in the magnetic path is reduced, whereby the inductance of the ballast may be substantially reduced. After starting and reignition of the discharge lamp FL, the lamp current in each half cycle is determined by parameters of the source voltage, lamp voltage and the ballast impedance. Since the starting time and period for supplying the intermittent oscillation output is controlled in principle in the same manner as its phase relationship by means of the capacitor C2, or by a combination of a voltage source forward oscillation with the conversion of energy stored in the current limiting means CL without an invasion of the preceeding half cycle of the lamp current in each half cycle of the a.c. power source. Thus, the required impedance of the ballast or current limiting means CL is substantially reduced or minimized, for example, to the ideal value of about one twenthieth of the conventional ballast impedance based on a theoretical calculation.

FIG. 8 shows a circuit diagram in which a discharge lamp FL provided with filaments *f* and *f'* is operated with certainty by supplying current from a low-frequency a.c. power source E with a frequency of 50 or 60 Hertz. For preventing radio noise and/or for improving power factor, a capacitor CP having a very small capacitance in comparison to that of a conventionally necessary capacitor, is connected across the power source E. A primary winding L10 of a transformer TR having a supplemental winding L20 and a pair of filament windings H and H' is connected in parallel with the low frequency a.c. power source E, and also in parallel with the series circuit of the current limiting means CL such as a current choke or choke coil CH and the discharge lamp FL. The choke coil CH which acts as an energy coupling means CT for low and high frequency components, to the discharge lamp FL is provided with primary and secondary windings W10 and W20. That is, the secondary winding W20 superimposes the low frequency voltage from the power source E and the oscillation output voltage from the booster circuit R2. One end of the secondary winding W20 is connected to the junction of the primary winding W10 of the choke coil CH and the discharge lamp FL. The other end of the winding W20 is connected through the capacitor C2 with the other end of the oscillation circuit R2 to provide an intermittent oscillation. One end of the circuit R2 is connected to one end of the supplemental winding L20 of the transformer TR.

Incidentally, in the embodiment described hereinafter, the coupling means CT and the current limiting means CL are combined as the choke coil CH having the primary winding W10 which acts as a current limiter and the secondary winding W20 which acts as a coupling means. Thus, the supplemental winding L20 is connected in series with the boost circuit R in order to enhance the starting of the oscillation operation.

In addition to the elements described above with reference to FIGS. 1 to 6, the booster circuit of FIG. 8 comprises a discharging resistor rd connected between a junction (a) of the inductor L2 and the thyristor S and a junction (b) of the capacitor C2 and the secondary winding W20 of the choke coil CH. Instead of to the junction (b), the resistor rd may be connected to a junction of the secondary winding W20 and the discharge lamp FL. In FIG. 8, the primary winding W10 and the secondary winding W20 of the choke coil CH are connected in a polarity adding manner.

The circuit of FIG. 8 operates as follows. When the power source E is switched on, low frequency voltage is applied to the discharge lamp FL and heating voltage induced on the windings H and H' is applied to the filaments *f* and *f'* of the lamp FL. At this point of time, the operation of the discharge lamp does not yet start. The step-up voltage induced across the supplemental winding L20 of the transformer TR, is supplied to the oscillation circuit R2 through the primary winding W10 and through the secondary winding W20 of the choke coil CH and the capacitor C2.

This step-up voltage serves to switch on the thyristor S of the oscillation circuit R2 and to thereby generate a high frequency oscillation in the oscillation circuit R2. The resulting oscillating voltage is supplied to the discharge lamp FL through the choke coil CH and through the supplemental winding L20 of the transformer TR. As a result, the discharge lamp FL to which the power source voltage of the low frequency and the oscillating voltage of the high frequency are applied in superimposed fashion will be lit.

During the first half cycle of the low frequency source voltage, when the oscillation circuit R2 starts to oscillate, the output current of oscillation flows into the current limiting means of the choke coil CH, through the transformer TR and through the capacitor C2. Since the capacitor C2 and the transformer TR each have a small reactance at high frequency respectively, the output voltage of oscillation is first applied to the secondary winding W20 of the choke coil CH, and the voltage induced across the primary winding W10 is applied to the discharge lamp FL. Thus, the lower frequency component of the a.c. power source E and the higher frequency component of the oscillation output are both supplied to the discharge lamp FL. The latter component serves to operate or light the discharge lamp FL in a given period of the leading portion of each half cycle of the lamp current.

Meanwhile, the capacitor C2 is charged to its terminal voltage VC2 during the oscillation of the oscillation circuit R2. Since the polarity of charge on the capacitor C2 is in the direction for reducing the step-up voltage VL10 + VL20 of the transformer TR as shown in FIG. 9 (A), the impressed voltage on the thyristor S is reduced by charging the capacitor C2. Said impressed voltage is the difference between the voltage VC2 of the capacitor C2 and of the step-up voltage VL10 + VL20 of the transformer TR. When the impresed voltage falls below the break-down voltage VBO, the oscillation is discontinued by stopping the input current to the oscillation circuit R2. Accordingly, for the remaining duration of the first half cycle, the discharge lamp is kept lit only by the lower frequency component of the power source E, and the terminal voltage of the capacitor C2 is kept constant. During the lamp operation, the oscillation of the booster circuit definitely becomes an intermittent oscillation. In other words, a continuous oscillation may be used for the preheating of the starting period of the discharge lamp in accordance with the present invention.

During the next half cycle of the low frequency voltage of the power source E, the peak voltage in the charging state of the capacitor C2 is maintained during the stopping interval in the intermittent oscillation of the circuit R2, near the low frequency voltage VL10 + VL20 of the transformer TR supplied to the oscillation circuit R2, as shown in FIG. 9 (A). Since the polarity of this next half cycle of the source voltage is opposite to the polarity of the previous half cycle, the terminal voltage VC2 of the capacitor C2, which reduced the step-up voltage of the transformer TR during the trailing portion of the previous half cycle, is now added to the reversed step-up voltage during the leading portion of this next half cycle, thus the thyristor conducts when VL10 + VL20 from the power source E reaches the breakdown voltage VBO of the thyristor S. In other words, the current IC2 which is supplied to the oscillation circuit R2 flows during a very short time in the polarity reversing period of the terminal voltage VC2 of the capacitor C2, as shown in IC2 of FIG. 9 (A). During this period of the leading portion of the half cycle, the oscillation circuit R2 generates a high frequency output. However, during the other period of the rear portion of the half cycle, the oscillation of the circuit R2 stops due to the polarity change in the charging capacitor C2 and due to the resulting reduction in the step-up voltage VL10 + VL20. The time and the location of the oscillation period in each half cycle can be regulated by the desired conditions for lighting the discharge lamp FL, and the above described intermittently oscillating operation of the booster circuit R is repeated for each half cycle thereafter. In other words, the step-up voltage advances or accelerates the time when the oscillation begins in the booster circuit R. Therefore, the circuit will be referred to as an operation advancing voltage source.

The supplemental winding L20 of the transformer TR in FIG. 8 is provided for obtaining the low frequency step-up voltage VL10 + VL20 which is applied to the oscillation circuit R2 and which is higher than the low frequency voltage VL10 applied to the discharge lamp FL. The oscillation circuit R2 may be operated in advance to the lighting operation of the discharge lamp FL by reason of the function of the voltage VL20 as a so called operation advancing means. When the waveform of the current IC2 is shifted to the left as shown by the arrow in FIG. 9 (A), so as to advance the current, the power factor of the lighting operation of the discharge lamp FL is improved. For example, a high power factor such as 0.85 or higher values may be obtained. Since the current capacities of the supplemental winding L20 of the transformer TR and of the secondary winding W20 of the choke coil CH are small, these windings require hardly any increase in size and volume. FIG. 9 (A) shows that the step-up voltage VL10 + VL20 is applied to the booster circuit R and the difference voltage between the step-up voltage and the charged voltage VC2 is applied to the oscillation circuit R2.

From the above, the power source voltage VE and the lamp voltage VT can be very close to each other, as shown in FIG. 9 (B), and a relation of VT ≧ VE is r.m.s. (root mean square) values is obtained. It is important that there is no spike voltage at the standing portion of the lamp voltage VT, since the starting or the reignition of the discharge lamp FL begins by supplying an oscillation output through the coupling means of the secondary winding W20 in each half cycle of the lamp current IFL.

Further, the lamp voltage VT has a rectangular shape. Briefly, it is possible to maintain the lighting operation since the instantaneous value of the voltage VL10 or the source voltage VE exceeds the instantaneous value of the flat portion of the lamp voltage VT. In other words, it is possible, according to the invention to employ a discharge lamp FL having lamp voltage VT which is 1.4 times the rated source voltage in r.m.s. value.

As mentioned above, the booster circuit R acts as an intermittent oscillator only when the polarity of the capacitor C2 is reversed in each half cycle. The resulting oscillation output appears as an electromagnetically induced voltage in the primary winding W10 and is superposed through the secondary winding W20 of the choke coil CH on the voltage VL10 in the primary winding L10 of the transformer TR. Thus, both superposed voltages are applied to the discharge lamp FL. When the filaments *f* and *f'* of the discharge lamp FL are heated sufficiently by the secondary windings H and H' of the transformer TR, the discharge lamp FL starts its operation triggered by the high frequency oscillation output and continues its lit state by the low frequency component of the source voltage after stopping of the oscillation output in this half cycle. The shifting time from the high frequency component in the intermittent oscillation to the low frequency component for the discharge lamp FL is determined by the time for the initiation of the intermittent oscillation, which can be controlled by using operation advancing means such as the supplemental winding L20 or the capacitor C2 for increasing the operation period of the discharge lamp by the low frequency component.

In the next half cycle, since the superposed voltage comprising the oscillation output voltage VL20 and the voltage VL10 is again applied to the discharge lamp FL, the discharge lamp FL starts its operation due to the oscillation output, even though the voltage VL10 is below the discharge sustaining voltage VT of the discharge lamp FL. The operation of the discharge lamp FL is repeated as described. FIG. 9 (B) shows such conditions in which VR is the oscillating voltage, VT is the lamp voltage, and IFL is the basic lamp current. During the standing portion of the lamp current IFL, namely when the lamp current alone would be insufficient to maintain the lamp in its lit condition, an oscillation current flows in the opposite direction to that of the basic lamp current, whereby the excited or lit state of the filling gas is maintained.

The relationship of the lamp voltage VT and the source voltage VL10 or VE will now be considered. The terminal voltage of the primary winding W10 of the choke coil CH is given by the voltages of the odd harmonics which are obtained by reducing the lamp voltage VT to the rectangular waveform from the source voltage in the fundamental sine waveform. However, since the odd harmonics constitute a convergent series, as may be shown by a Furier expansion, the main part comprises the third and fifth harmonics, the amplitudes of which are only $\frac{1}{3}$ and 1/5 respectively.

Therefore, these harmonics are suitable to minimize the apparent size of the current limiting means CL of the choke coil CH, whereby a significant miniaturization is accomplished compared to a conventional single choke, because the terminal voltage of the choke coil CH is thus reduced according to the invention. It is also important that the phase of the input current is almost the same as that of the source voltage VL10, because thereby a high power factor operation is achieved without the use of a capacitor for improving the power factor, or only a small capacitance capacitor may be required for improving the power factor. This is a significant merit of the lighting system of the invention.

Generally, when the terminal voltage of the current limiting means CL is reduced, current variations or fluctuations may cause a problem even though the discharge lamp is lit. However, the secondary winding W20 of the choke coil CH in FIG. 8 improves the ratio of variation, because the charging current for the oscillation circuit R2 has a magnetic exciting effect, which compensates that of the lamp current relative to the source voltage. The relatively small variation of the discharge lamp voltage relative to the variation of the source voltage is another merit of this system. This means that the discharge lamp is little influenced by any source voltage variations. A further advantage is seen in that the addition of the resistor rd in FIG. 8 stabilizes the oscillation by changing the constant terminal voltage of the capacitor C2, particularly in a circuit from which the discharge lamp has been removed.

FIG. 9 (C) illustrates a simplified relationship between the source voltge VE of the power source E and the lamp voltage VT of the discharge lamp. The waveform of the lamp voltage VT has a rectangular shape with a quiescent period between adjacent rectangles. The intermittent operation of the booster circuit R is determined during a given portion of said quiescent periods. Therefore, the effective lamp voltage VT will be in the range of about 90 to 95 percent of the value in a conventional lighting system. In the present system the discharge lamp is forced to reignite due to the oscillation output voltage VR during the standing portion of each half cycle of the lamp current. In other words, at every reignition time, ion extinguishment within the discharge lamp FL is prevented by applying the oscillation output to the discharge lamp FL, while intermittent current from the booster circuit R flows into the secondary winding W20. The terminal voltage of the secondary winding W20 corresponding to the intermittent current coupled to the discharge lamp FL through the primary winding W10. Where the standing portion of the lamp current IFL is kept in constant phase or substantially in the same phase with each half cycle of the source voltage regardless of the variations of the source voltage, the fluctuations of the lamp current may be maintained within acceptable limits in the present system. FIG. 10 shows a circuit diagram of a modification of FIG. 8 for lighting two discharge lamps FL1 and FL2 is series connection. For sequential lighting of these discharge lamps, a resistor RS is connected in parallel to one discharge lamp FL2. The discharge lamps FL1 and FL2 are sequentially operated in this order due to the function of the impedance of the resistor RS. The resistor RS may be replaced by a capacitor for reducing power loss. The operation of this circuit arrangement is similar to that of the circuit arrangement shown in FIG. 8.

FIG. 11 is a circuit diagram of another embodiment of this invention, in which a 200-volt line voltage is used as the a.c. power source E, instead of the 100-volt source voltage for a 40W 12 type fluorescent lamp. In FIG. 11 the supplemental winding L20 of the transformer TR may be removed. The transformer TR is used only for the filament heating circuit. A capacitor CS connected in parallel to the discharge lamp FL2 advances the position of the standing portion of the lamp current so that the supplemental winding L20 is not required where a capacitor CS is used as the operation advancing means, the terminal voltage across the primary winding W10 of the current limiting means CL of the choke CH is 75 volts, which is about one fourth of the 300-volt terminal voltage in a conventional lighting device for dual discharge lamps requiring a terminal voltage of about 150V for each lamp. Therefore, the primary winding W10 is designed to have a volt-ampere rating (VA) corresponding to about ¼ of that of a conventional choke. The power factor is also improved in this embodiment, and the auxiliary capacitor CP for improving the power factor, as shown in FIG. 8, may be eliminated or reduced in its capacitance. The result is a considerably miniaturized ballast for two discharge lamps and an economical lighting device.

In the embodiment of FIG. 10, the high frequency component of the intermittent oscillation output generated in the oscillation circuit R2 is coupled through the capacitor C2 and through the current choke coil CH to the discharge lamp FL1 whereby the discharge lamp FL1 is lit first. Thereafter, a closed loop or circuit path is formed for the high frequency component, which is supplied to the discharge lamp FL1 through the choke coil CH and through the power source E. This closed circuit or loop formed in FIG. 10 permits a partial leakage of the high frequency component to the power source E. In contrast to this, the high frequency component in the embodiment of FIG. 12 forms such closed loop within the discharge lamp FL2 together with the capacitors C5 and C6. Therefore, the discharge lamp FL2 is first lit in the loop of the capacitors C5 and C6 and the discharge lamp FL2, and then the discharge lamp FL1 is lit by the low frequency component from the power source. Thus, the high frequency component does not flow to the a.c. power source E and becomes independent of the low frequency component of the power source. Incidentally, FIG. 12 is a circuit diagram of a modification of FIG. 11, wherein the capacitor C of the oscillation circuit R2 comprises a series capacitance of capacitors C4 and C5. FIG. 13 is a circuit diagram of a modification of FIG. 12, wherein the booster circuit R including the oscillation circuit R2 with the variable capacitor CC is connected through a variable capacitor CF to a juntion of the discharge lamp FL1 and the discharge lamp FL2. The capacitance value of the variable capacitor CF adjusts the current through the discharge lamp FL2 so as to cause a sequential operation. The same effect is also achieved by changing the capacitance value of the variable capacitor CC for the oscillation in the oscillation circuit R2. The resistor rd connected between one end of the power source E and the junction of the non-linear inductor L2 and the thyristor S serves to improve, that is, reduce fluctuations of the power source E.

Regarding FIGS. 11 to 13, it may be summarized that the discharge path for the high frequency component generated in the oscillation circuit R2 is actively or positively established prior to the discharge path for the low frequency component supplied by the low frequency a.c. power source by short-circuiting one of the two discharge lamps with regard to the high frequency component, through the capacitor at each standing portion of the lamp current for the discharge lamp, whereby first one of two discharge lamps is lit and then to sequentially operate the other of the two lamps by the low frequency a.c. power source. In these embodiments the power source voltage corresponds substantially to the lamp voltage so that the reduction of the terminal voltage of the choke coil CH and a high power factor lighting operation are successfully achieved. In conventional circuits, it was necessary that the power source voltage was about two times the lamp voltage on the assumption that the oscillation of the oscillation circuit stops during the lighting operation of the discharge lamp. Contrary thereto, according to the invention, an instantaneous value of the source voltage is established to be substantially equal to the instantaneous voltage in the middle portion of the lamp voltage VTm at the maximum condition, see FIG. 9 (B). This has the advantage that the ballast structure may have a volt-ampere (VE) value of about one fourth of the size of a conventional single-choke and it may be miniaturized even more than the sequential lighting devices while simultaneously reducing the power loss.

FIG. 14 shows a circuit diagram of another embodiment of the present invention with an electronic preheating circuit PRH for lamps of the preheating type. The circuit PRH replaces the heating windings H of the transformer TR in the embodiments of FIG. 8 and 10 to 13. The present preheat circuit includes a resonance circuit having a small capacitance capacitor C20 and a small inductor L30 connected in series with each other. The junction (h) of the capacitor C20 and the inductor L30 is connected to one end of the booster circuit R2 to form an operation advancing high voltage source between the terminals of the capacitor C20. A series circuit of an inductor BL for blocking high frequency components of the oscillation output from the booster circuit R2, and a thyristor SP of the bidirectional diode type having a breakdown voltage higher than the lamp voltage VT of the discharge lamp FL is connected between filaments *f* and *f'* of the discharge lamp FL. This series circuit preheats the filaments *f* and *f'* of the discharge lamp FL and is called hereinafter "electronic filament preheating circuit" in accordance with the present invention. In this electronic filament preheating circuit a winding W30 may be added to the choke coil CH for adjusting the preheating current through the filaments *f* and *f'*. The oscillation circuit R2 has a bias winding BW electromagnetically coupled with the non-linear inductor L2 in an additive manner for causing an oscillation output from the booster circuit R2 as shown and described in FIG. 7 (C). The essential features of this circuit are the same as those of the circuit shown in FIG. 8, and therefore like parts are designated by like reference characters.

The booster circuit R2 of FIG. 14 generates an intermittent oscillation in each half cycle of the source voltage when the a.c. power source E is switched on as described before. The oscillation output which is coupled or superposed with an inverted polarity on the source voltage, is applied to the discharge lamp FL and to the filament preheating circuit PRH in parallel therewith. When the superposed voltage of the high frequency oscillation and of the low frequency power source is supplied to the filament preheating circuit PRH, it is also applied through the inductor BL for blocking high frequency across the thyristor SP to drive it into the conducting state by the so called dv/dt effect. In the trailing part of the operating period of the high frequency oscillation, current from the power source E flows in the circuit through the filament *f*, the inductor BL, the thyristor SP, and the filament *f'* to preheat the filaments *f* and *f'* under the phase control of the current.

Since the thyristor SP is driven to its conduction state each time when the oscillation output of the booster circuit R2 is applied to the filament preheating circuit PRH, the current from the power source E preheats the filaments *f* and *f'* during the condution period of the thyristor SP. As a result, the discharge lamp FL is ready to start operation in response to a trigger from the oscillation output, as described with reference to FIG. 8, when the starting voltage required for the discharge lamp FL is reduced by a sufficient preheating of the filaments *f* and *f'*. By starting the operation of the discharge lamp FL, the major proportion of intermittent oscillation output is supplied to sustain the conductive state of the discharge lamp FL while a minor proportion of the output is used in the inductor BL for blocking high frequency. However, the thyristor SP does not conduct thereafter, because its break-over voltage VB0 is selected to be higher than the lamp voltage VT. Accordingly, the discharge lamp FL maintains its operation from the source voltage in cooperation with the starting and reignition operation in each half cycle of the power source E, although the preheating of the filaments *f* and *f'* is stopped thereafter. According to this embodiment, the weight and volume are reduced, since the filament heating windings H and H' of the transformer TR shown in FIG. 8 have been replaced by the electronic filament preheating circuit PRH. Thus, the compactness of the overall structure is also an important advantage of the present invention.

FIG. 15 shows a modification of FIG. 14, in which the capacitor CP is only connected across the a.c. power source E for preventing noise and for improving the power factor. In this embodiment the capacitor CP is not used for the operation advancing means. It is important that the booster circuit R2 is coupled to the secondary side of the discharge lamp FL, that is, away from the power source. The booster circuit R2 is thus also coupled to the electronic filament preheating circuit PRH, whereby an input current passing through filaments *f* and *f'* is supplied to the discharge lamp FL for generating an intermittent oscillation. Therefore, the preheating current for the filaments is the input current of the booster circuit R2 which has a waveform of a sine or an intermittent sine shape due to the choke coil CH and the capacitor C2.

In the embodiment of FIG. 15, the bias winding BW of FIG. 14 is replaced by an external small capacitor C3 across the non-linear inductor L2 for increasing the oscillation voltage, as shown and described with reference to FIG. 7 (B). That is, the bias coil BW in FIG. 7 (C) is replaced by the capacitor C3 for increasing the equivalent capacitance of the oscillation circuit R3 in FIG. 7 (B). This is convenient where the inductor L2 does not have a distributed capacitance so that the maximum output, depending on the frequency of the backswing voltage, is obtained from the oscillation circuit R2. If the operation advancing means are omitted, the oscillation circuit R2 could, though rarely, malfunction due to the charging of the capacitor C2 for the intermittent oscillation. The circuit arrangement of FIG. 15 avoids such malfunction due to the discharging resistor rd for the capacitor C2 connected across the thyristor S. This resistor rd prevents an abnormal charging of the capacitor C2 due to the series circuit of the nonlinear inductor L2 and the discharging resistor rd.

For lighting two discharging lamps FL1 and FL2 in a series connection, the circuits of FIGS. 16 to 18 illustrate sequence type lighting devices. In FIG. 16, each of the discharge lamps FL1 and FL2 has a filament preheating circuit PRH as shown in FIG. 14. A small capacitance capacitor CF for passing the high frequency component is connected between the booster circuit R2 and the filament f2 of the discharge lamp FL2, whereby the oscillation output is applied to the discharge lamp FL2. By this connection the function of the operation advancing means for the intermittent oscillation is successively achieved. In this circuit arrangement, when the fluorescent discharge lamps FL1 and FL2 are of the 40-watt T10 type and the source voltage is 200 volts, voltage between the ends of both discharge lamps FL1 and FL2 in the lit condition is about 220 volts. As a result, the current limiting means CL of the choke coil CH may be substantially reduced in size due to the low voltage between the ends of the choke coil CH, in a similar manner as described above. Further, the capacitor C2 for the intermittent oscillation and the noise prevention capacitor CP are contained in a common casing having three terminals, and the resistor rd for discharging the capacitor C2 is connected only across the capacitor C2.

In the above arrangement, the booster circuit R is first started by connecting the a.c. power source E to generate an intermittent oscillation output. Since each of the thyristors SP1 and SP2 of the preheating circuits PRH1 and PRH2 is selected so that its break-over or break-down voltage VBO is about 200 volts, either thyristors SP1 and SP2 does not start conducting even if the superposed voltage of the source and of the oscillation output is applied in reversed polarity between the terminal ends of the discharge lamps FL1 and FL2. While the oscillation output of the booster circuit R is also applied to the discharge lamp FL2 through the capacitor CF, the discharge lamp FL2 will be excited in the conductive state due to the ionization of the filling gas in the discharge lamp FL2 by the high frequency component. However, the lamp FL2 will not yet be lit at this conductive state. The superposed voltage which is applied to both discharge lamps FL1 and FL2 to that time, is then applied by passing through the discharge lamp FL2 to the other discharge lamp FL1 and the filament preheating circuit PRH1, whereby the latter causes the conductive state of the lamp FL1. This conduction permits the low frequency to pass current from the power source E through the filaments f1 and f1' of the discharge lamp FL1 whereby they are heated. Also, at this time, the other filament preheating circuit PRH2 establishes its conduction state, since the source voltage and the oscillation output are applied due to the conduction of the filament preheating circuit PRH1 whereby the filaments f2 and f2' of the discharge lamp FL2 are heated. After the filaments f1, f1', f2 and f2' of discharge lamps FL1 and FL2 have been sufficiently preheated, each of discharge lamps FL1 and FL2 starts its lighting operation and the source voltage continues the lit condition while a starting or reigniting takes place in every half cycle of the power source E due to the oscillation output.

FIG. 17 shows a modification of the circuit of FIG. 16, wherein the thyristors may have a break-over voltage of 100 volts, as compared to 200 volts in FIG. 16. Each of the thyristors SP1 and SP2 of the filament preheating circuits PRH1 and PRH2 and the thyristor S of the booster circuit R in FIG. 16 is formed by a two element series circuit of thyristors having a 100 volts break-over voltage, whereby six thyristors may be required for the circuit of FIG. 16. The circuit of FIG. 17 is intended to reduce the number of thyristors by way of common use. Thus, one of the thyristors for the filament preheating circuit PRH2 is omitted due to the common use of the thyristor S2 of the booster circuit R, whereby costs are reduced.

FIG. 18 shows a circuit arrangement wherein each of the filament preheating circuits PRH1 and PRH2 employs a bidirectional triode thyristor TRI1 or TRI2 also known as "triac". Between the gate electrodes G1 and G2 of these triacs TRI1 and TRI2, impedance elements Z are inserted. The source voltage and the output oscillation are applied in superposed fashion between both ends of the triacs TRI1 and TRI2 whereby current flows with the high frequency component during the unlit state of the discharge lamps, and the triacs TRI1 and TRI2 are driven into the conduction state by reducing the break-over voltage VBO thereof so that each of the filaments f1, f1', f2 and f2' is preheated. On the other hand, the discharge lamps FL1 and FL2 are in a conductioned state during the lighting operation so that the high frequency gate current in the triacs TRI1 and TRI2 may be small. Hence, the triacs TRI1 and TRI2 become nonconductive due to the increased break-over voltage VBO thereof. It is an advantage of this circuit that the inductors BL1 and BL2 for blocking the high frequency component may be substantially miniaturized or even omitted.

In the circuits described above, one or more parallel capacitors or series high frequency filters may be added to the power source for noise prevention rather than power factor improvement. Summarizing, the preheating type discharge lamp is started and reignited by the intermittent oscillation output of the booster in each half cycle of the lamp current. During the unlit state of the discharge lamp, the filament preheating circuit is conducting due to the oscillation output for preheating the filaments whereby the filament windings may be removed from the circuit such as the embodiment of FIG. 8, whereby the transformer having a substantial weight and volume may be eliminated to provide a greatly miniaturizable device which has many advantages as described above.

In all the embodiments of the present invention, the current limiting means CL is the inductance of the choke coil CH. The coupling means CT for superposedly supplying the high frequency oscillation voltage and the low frequency source voltage to the discharge lamp FL is accomplished by the coupling of the primary and secondary windings of the choke coil CH. The current limiting means CL is replaced partially or wholly by an impedance element, such as a capacitance element, or by a semiconductor type equivalent resistance element, or by a combination of a semiconductor control element and the choke coil CH. Especially coupling means which superpose the oscillation energy and the power source energy result in the substantial merits of the present invention as described.

FIG. 19 shows a circuit of one of the most practical lighting devices of the invention using the input current of the booster circuit R for the filament heating. The device has a resonance circuit for improving the noise prevention. A discharge lamp FL such as a 40-watt fluorescent lamp is connected in series with the a.c. power source through a current choice CH of the current limiting means CL which includes a secondary winding W20 of the coupling means CT for transferring the oscillation output of the booster circuit R to the discharge lamp FL in superposition with the voltage of the a.c. power source E. One end of the secondary winding W20 is connected to one end of the filament *f* of the discharge lamp FL and the other end is connected to one end of the booster circuit R which includes an oscillation circuit R2 and a capacitor C2 in series connection as described. The other end of the booster circuit R is connected to one end of the filament *f'* of the discharge lamp FL. An inductor LK and a capacitor CK are a part of the power source circuit and form a resonance circuit K at the output side of the booster circuit R for amplifying the oscillation voltage which is applied by the booster to the discharge lamp FL. The resonance circuit K produces a higher starting voltage for the discharge lamp FL in order to decrease the frequency and/or the voltage of the oscillation output of the booster circuit R. The resonance circuit K also improves the noise prevention as well as the miniaturization of the lighting device. The capacitor CK of the resonance circuit K is preferably connected across the side of the discharge lamp FL opposite the side connected to the power source, and between the respective ends of the filaments *f* and *f'* so that the oscillation current flows into the filaments *f* and *f'* to heat them whereby the filaments are heated by the booster circuit R. The inductor LK of the resonance circuit K is connected in the power sorce side of the discharge lamp FL, e.g. between one end of the power source E and the other end of the filament *f'*. In this circuit arrangement, the filament preheating circuit PRH shown in FIGS. 14 to 18 and the filament windings H and H' of the transformer TR of the circuit as shown in FIG. 8 are obviated. Thus, a small size device with simple filament heating means is provided in an economical manner. Also, filament preheating during the unlit state, may be accomplished by the continuous oscillation produced by the suitable selection of the values of the primary winding W20 and/or the capacitor C2.

FIG. 20 shows a circuit diagram of still another embodiment for operating two discharge lamps in series, wherein a single filament heating winding WHf is added for supplying an induced high frequency voltage from the oscillation output in order to heat the filaments f1' and f2 of both discharge lamps FL1 and FL2. The other filaments f1 and f2' are heated by input current for the booster circuit R passing through them. The series resonance circuit K of the inductor LK and the capacitors CK1 and CK2 is inserted. Each of the capacitors CK1 and CK2 is connected, for instance, across its respective discharge lamp FL1 or FL2 on the side opposite the power source. One of these capacitors, such as CK2 has a small capacitance for sequential operation. If necessary for heating the filaments f1 and f2', filament heating windings coupled with the secondary winding W20 of the coupling means CT may be added. Also, the separate capacitors CK1 and CK2 may be replaced by a single capacitor CK, as shown in FIG. 22, and a capacitor CS connected across one discharge lamp FL2 for sequential starting operation. This circuit arrangement is most practical because it is simple and assures the sequential operation of the two lamps with a single set of current limiting means, coupling means, the booster circuit and the resonance circuit.

FIG. 21 shows a circuit diagram of another embodiment using a resonance circuit K, wherein a transformer TR having a tap *t* connected to one end of the discharge lamp FL, and filament windings H and H' for preheating the filaments *f* and *f'* of the discharge lamp FL, is connected across the a.c. power source E. The resonance circuit K comprises an inductor LK connected in series with the discharge lamp FL and a capacitor CK connected in parallel with the discharge lamp FL. A discharge resistor rd is connected across the thyristor S for discharging the energy stored in the booster circuit R. The other elements are the same as those described, and a 110-watt fluorescent lamp may be employed in this circuit arrangement.

The inductor LK of the series resonance circuit K, which is an important part in the circuit arrangement of FIG. 21, has a gap and about several to several ten millihenries. The inductor LK is inserted in the current path for the discharge lamp and the capacitor CK is connected across the discharge lamp. It is possible to use a stray capacitance inherent in the wiring or in the assembled structure, instead of the capacitor CK. The values of the inductor LK and the capacitor CK including any stray capacitance are predetermined to provide for a specific resonance frequency of the oscillation output generated by the booster circuit R so that the terminal voltage of the capacitor CK may be elevated to a value of about two to ten times the voltage of the oscillation output voltage VR. Since an excess of high voltage is undesired, the circuit constant is selected at a relatively low ratio, for instance, 1400 volts of high voltage is enough to assure starting at low temperatures. Such a starting voltage of 1400 volts is produced across the capacitor CK from 700 volts of the oscillation output voltage VR.

Noise generated by the operation of the discharge lamp is suppressed by a capacitor CN, which may be a stray capacitor connected across the power source side of the discharge lamp FL so as to form a - type noise filter with the capacitor CK in the series resonance circuit K. If the capacitance CN is substantially eliminated, an L-type noise filter is provided by the series resonance circuit itself. The inductor LK reduces radiation noise by rounding the waveform of the high frequency current, it also recudes the line noise.

The operation of the discharge lamp FL in the circuit of FIG. 21 will now be described. Starting or reignition takes place in each half cycle of the lamp current. By applying the voltage VR of the oscillation output, the series resonance circuit K resonates with such voltage and produces an elevated voltage across the capacitor CK. The elevated voltage is applied across the discharge lamp FL. Such high voltage application assures a definite starting and reignition of the discharge lamp FL under any conditions at normal, high, and low ambient temperatures. Starting and reignition at high ambient temperatures is assured, since the lamp voltage VT is decreased. The standing portion of the lamp voltage lags in the phase relation in the normal mode of operation. Therefore, the forced reignition of the discharge lamp FL should be established prior to the standing portion in the related or corresponding phase. For this purpose, it is necessary to sufficiently supply the oscillation output through the series resonance circuit K at a moment of reignition for overcoming the lamp voltage by the elevated voltage which is definitely provided between the terminals of the capacitor CK due to the oscillation output of the booster to cause reignition in each half cycle.

In this circuit arrangement, it is an important advantage that the circuit may easily be adapted to different lamp types by selecting the resonance circuit K or rather suitable values of the inductor LK and the capacitor CK. For example, if the lighting device is designed for a low wattage discharge lamp the booster circuit R would generate a relatively low frequency and/or voltage oscillation output. In this instance, a resonance circuit K having suitable constant values for operating a high output type discharge lamp, such as a 110-watt fluorescent lamp or a high pressure discharge lamp, such as a mercury lamp, may easily be modified by changing LK and CK for operating said low wattage lamp. Another advantage is seen in that the series resonance circuit K may be formed by a small inductor LK and a small capacitor CK so that it is small, compact, and economically manufactured. It is preferred to construct the resonance circuit K as a single unit together with the distributed capacitance CN of the noise filter.

FIG. 22 shows a circuit diagram of a modification of FIG. 21 for two discharge lamps FL1 and FL2 in series connection and applicable to a conventional sequence lighting system for two 110-watt fluorescent lamps. In this case, the capacitor CK of the resonance circuit K is connected in parallel to the series connected discharge lamps FL1 and FL2. The capacitor CS for the sequential operation is connected across one of the discharge lamps FL1 and FL2, for instance FL2. The source voltage is 200 volts, and the transformer TR has a supplemental winding L20 to provide a step-up voltage of 300 volts to operate the booster circuit R. This supplemental winding L20 has a tap *t* to provide 250 volts to the discharge lamp FL. The supplemental winding L20 is added to the transformer TR in order to prevent an abnormal oscillation and to provide the operation advancing means as defined above.

FIG. 23 is a modified circuit for operating two discharge lamps using two resonant circuits K1 and K2 with respective current choke coils CH1 and CH2. Each of the resonance circuits K1 and K2 is connected to the power source side of respective discharge lamps FL1 and FL2. The secondary windings W201 and W202 within the choke coils CH1 and CH2 are connected in series with the booster circuit R.

FIG. 24 is a circuit modification of FIG. 21, in which the booster circuit R is connected across the discharge lamp FL opposite the power source so to speak, for preheating the filamens *f* and *f'* whereby to eliminate the filament windings. The resonance circuit K includes an inductor LK which comprises a primary winding WK1 connected to the discharge lamp FL opposite the power source. The secondary winding WK2 is connected in the power source side of the discharge lamp FL. In this circuit arrangement the primary winding WK1 of the inductor LK provides a series resonance circuit with the capacitor CK so that the secondary winding WK2 of the inductor LK prevents leakage of the high frequency component to the power source side.

FIG. 25 shows a circuit diagram of a modification of FIG. 24 in which one end of the capacitor CK is connected to a tap on the inductor LK to utilize the transforming function of the inductor LK for increasing the oscillation output voltage. This embodiment is suitable for high pressure discharge lamps. For preventing noise generation it is important that the core of the choke coil CH of the current limiting means CL and coupling means CT is grounded or connected electrically with the conductive housing. In FIG. 25 the cold cathode discharge lamp HL is connected across the resonance circuit K and to the booster R. In these embodiments, the supplemental winding L20 of FIG. 22 may be used to provide an operation advancing voltage source and for preventing an abnormal oscillation operation.

FIG. 26 shows a circuit of a further embodiment of the invention, in which an oscillation cancelling device ZLC is connected to cancel the output of the booster circuit R which output is applied to the filament preheating circuit PRH when the discharge lamp FL is lit. The device ZLC comprises a series circuit of a capacitor CZ and a primary winding LZ1 of a small transformer TS. The resonance frequency of this series circuit CZ, LZ1 is relatively high corresponding to that of the oscillation output of the booster circuit R. The inductance of the primary winding LZ1 and of the capacitor CZ are selected accordingly. The filament preheating circuit PRH comprises a secondary winding LZ2 of the small transformer TS and a thyristor SP in series therewith. The secondary winding LZ2 is electro-magnetically coupled, in reverse polarity, with the primary winding LZ1 and the winding ratio of LZ2 to LZ1 is in 1 : 1. Since the small transformer TS serves to induce a reversed voltage on the secondary winding LZ2 by applying a high frequency voltage corresponding to the oscillation output of the primary winding LZ1, both windings LZ1 and LZ2 do not require large inductance values. To prevent leakage of the oscillation output from the booster circuit R, a bypass capacitor CB is connected across the power source E. The capacitor CN eliminates any high frequency noise generation when the discharge lamp is lit. A winding W30 of the choke coil CH is connected in series with the filament preheating circuit PRH to adjust the filament current when the filament preheating circuit conducts due to the oscillation output.

In the circuit of FIG. 26, the operation of the booster circuit R can be stopped automatically if the filament *f* or the filament *f'* is broken or when the discharge lamp FL is not yet fitted into the lighting device. It is also advantageous to increase the filament preheating current by passing the input current of the booster circuit R through the filaments *f* and *f'*. On the other hand, the oscillation cancelling device ZLC resonates with the oscillation output of the booster R, and the high frequency, high voltage of the primary winding LZ1 is induced, in reverse polarity, in the secondary winding LZ2, so that the oscillation output supplied to the thyristor SP from LZ2 may be reduced. This effect occurs during the second half of the oscillation period when the booster output is increased, but the conducting state of the thyristor SP is not prevented when the lamp is not lit, so that the entire booster output is applied to the filament preheating circuit PRH when the lamp is not lit. However, when the lamp is lit, the major proportion of the booster oscillation output flows through the discharge lamp FL in the conduction state, and a minor proportion of the booster output flowing into the filament preheating circuit when the lamp is lit, is cancelled by the resonance of the cancelling device ZLC.

Accordingly, any erroneous operation of the filament preheating circuit when the lamp is lit is prevented by the use of the small transformer TS instead of the inductor BL for blocking high frequency as shown in FIGS. 14 to 17. The thyristor SP in FIG. 26 may be selected from a wide range of types such as those having a long turn-off time. A glow-starter may be used instead of the thyristor SP due to the cancellation of the high frequency output.

FIG. 27 shows a circuit diagram of another modification of FIG. 19. The resonance circuit K of FIG. 19 is removed in FIG. 27, but a capacitor CN for noise prevention is connected across the discharge lamp FL. The filaments *f* and *f'* of the discharge lamp FL are preheated by the input current of the booster circuit R. The capacitance of the capacitor C2 is larger than that of the capacitor CN and is used for the intermittent oscillation of the booster R. The core of the choke coil CH is grounded or electrically connected to the housing of the lighting device to reduce or prevent noise. FIG. 28 shows a circuit diagram of a modification of FIG. 27 for two discharge lamps FL1 and FL2. A transformer TH is provided for heating the filaments f1' and f2 of the discharge lamps. The primary winding WH1 of the transformer TH is connected in series with the power source E. The secondary winding WH2 is connected in series with the filaments f1' and f2. For sequential operation, a capacitor CS is connected between the discharge lamp FL1 and the secondary winding W20 of the choke coil CH. A capacitor CN may be connected across the power source side of the discharge lamps FL1 and FL2 for noise suppression.

FIG. 29 is a circuit diagram of a still further embodiment of the present invention, in which the noise level of the lighting device is reduced. Two discharge lamps FL1 and FL2 are operated in series connection. A filament heating transformer TR is connected across the power source E. A capacitor CNO is also connected across the source E to reduce noise. A noise prevention capacitor CN is connected between the two discharge lamps to provide a short-circuit for the high frequency and to absorb any reignition noise. This capacitor CN forms a resonance circuit with an inductor LN to provide an increased voltage across the two discharge lamps. Such a resonance circuit reduces or eliminates noise generation as described with reference to FIGS. 21 to 23. A capacitor CS is also connected across the discharge lamp FL1 to assure sequential operation. The capacitor CN may be replaced by separate capacitors, each of which is connected across each of the discharge lamps FL1 and FL2. This noise prevention circuit may also be used in a device having the filament preheating circuit PRH as described above. In this circuit arrangement, a discharging resistor rd for the capacitor C2 is connected across the thyristor S, and a core of the choke coil CH is connected to the housing of the lighting device.

FIG. 30 is a circuit diagram of a modification of FIG. 29 in which a supplemental winding L20 of the transformer TR is used as an oscillation operation advancing means. The primary winding L10 has a tap P from which the a.c. power is supplied to the series connected discharge lamps FL1 and FL2 through an inductor N. For noise prevention, capacitors CN1 and CN2 are connected across the discharge lamps FL1 and FL2 respectively. A capacitor CS for sequential operation, is connected between a junction of the secondary winding W20 and the booster circuit R on the one hand and the filament f1' of the discharge lamp FL1. The sequential capacitor CS may be omitted by using different capacitances for each of the capacitors CN1 and CN2. The resonance inductor LN may be omitted in the circuit of FIG. 30.

The discharge lamp in the present lighting device remains continuously lit due to the reignition in each half cycle caused by the high frequency high voltage intermittent oscillation output of the booster circuit. Thus, extinction or reduction of ions within the discharge lamp during the quiescent period of the low frequency current from the a.c. power source is compensated by the excitation due to the high frequency intermittent oscillation output. The present system is useful for economically operating any kind of discharge lamp.

What is claimed is:

1. A discharge lamp operating circuit system for sustaining the lit condition of discharge lamp means comprising an electrical a.c. source of power, lamp current limiting means for establishing lighting conditions for said discharge lamp means and connecting said power source to said discharge lamp means for supplying from said a.c. power source to said discharge lamp means a low frequency output current component having a quiescent arc discharge period within each half cycle thereof, oscillation booster circuit means providing a high frequency output current component, coupling means operatively coupling said discharge lamp means and said oscillation booster circuit means to supply said high frequency output current component to said discharge lamp means during a first period corresponding to a front portion of each half cycle, and wherein said low frequency output current component from said power source is supplied to said discharge lamp means during a second period corresponding to a rear portion of each half cycle, so that said high frequency output current component and said low frequency output current component are supplied to the discharge lamp means at different times within each half cycle, whereby the lighting operation of said discharge lamp means is sustained by compensation of reduced or extinguished ions within said discharge lamp means, during said quiescent period of said low frequency output current component and wherein the effective voltage supplied by said a.c. power source to the lamps operating circuit and the effective lamp voltage of said discharge lamp means are established substantially equal to each other to reduce the terminal voltage of said current limiting means.

2. The system according to claim 1, wherein said oscillation booster circuit means comprise means for supplying said high frequency current output component to said discharge lamp means in an intermittent manner for reigniting said discharge lamp means within said first period in each half cycle of the lamp current.

3. The system according to claim 2, wherein said discharge lamp means comprise two or more discharge lamps in series connection, and wherein the effective source voltage and the total lamp voltage of the series connection are established to be substantially equal to each other.

4. The system according to claim 1, wherein said oscillation booster circuit means comprise resonance circuit means for increasing the voltage of said high frequency output current component, said resonance circuit means including an inductor and a capacitor, said resonance circuit means being connected to the output side of said oscillation booster circuit means for adjusting the high frequency output component of said oscillation booster circuit means to a suitable level with respect to the type of the discharge lamp means.

5. The system according to claim 1, wherein said discharge lamp means has filaments of the preheating type, said system further comprising an electronic filament preheating circuit including a switching semiconductor which conducts in response to the oscillation output of said oscillation booster circuit means when said discharge lamp means are not lit.

6. The system according to claim 1, wherein said discharge lamp means has filaments which are preheated by the input current of the oscillation booster circuit, whereby filament loss is eliminated during the lighting operation of said discharge lamp means.

7. The system according to claim 1, wherein said discharge lamp means has filaments, said system further comprising filament heating means connected to said filaments and coupled to said oscillation booster circuit means for heating said filaments by an induced voltage of the high frequency oscillation output of the oscillation booster circuit means.

8. The system according to claim 1, further comprising noise preventing circuit means connected to the power source side of said discharge lamp means.

9. The system according to claim 1, wherein said oscillation booster circuit means supply said high frequency current output component in an intermittent manner, said system further comprising operation advancing means for controlling the beginning of operation of said oscillation booster circuit means to reignite said discharge lamp means by said intermittent oscillation output of said oscillation booster circuit means in each half cycle of the lamp current.

10. The system according to claim 1, wherein said discharge lamp means comprise filaments, said system further comprising filament preheating circuit means connected across that side of said discharge lamp means which is away from said power source, said preheating circuit means being coupled to said oscillation booster circuit means to be driven into the conduction state by the high frequency oscillation output of said oscillation booster circuit means for preheating the filaments of said discharge lamp means when said discharge lamp means are not lit, and whereby during the lighting operation said discharge lamp means is reignited in each half cycle of the lamp current by the intermittent oscillation output from said booster circuit means.

11. The system according to claim 10, further comprising oscillation cancellation means connected across said filament preheating circuit means for preventing an erroneous operation of said filament preheating circuit means.

12. The system according to claim 1, wherein said a.c. power source comprises transformer means having an output connected to the discharge lamp means through said lamp current limiting means so as to minimize the size of said current limiting means.

13. The system according to claim 12, wherein said transformer means has a supplemental winding to provide a step-up voltage for said oscillation booster circuit means.

14. The system according to claim 1, wherein said discharge lamp means has filaments, and said oscillation booster circuit means is connected across said discharge lamp means on the side thereof away from said power source, whereby said filaments of said discharge lamp means are heated by the input current of said oscillation booster circuit means.

15. The system according to claim 1, further comprising a series resonance circuit connected to said oscillation booster circuit means at its output side, said series resonance circuit comprising an inductor connected in series with said discharge lamp means and a capacitor connected in parallel with said discharge lamp means, said series resonance circuit having a resonant frequency corresponding to the frequency of the oscillation output of the oscillation booster circuit means to increase the voltage of the oscillation output, said increased voltage being applied to said discharge lamp means.

16. The system according to claim 1, wherein said discharge lamp means has a rated lamp voltage which is substantially equal to the effective source voltage of said a.c. power source.

17. The system according to claim 1, wherein said lamp current limiting means comprise a current choke having a primary winding forming said lamp current limiting means proper and a secondary winding forming said coupling means, said primary winding being connected in additive polarity relative to said secondary winding, said oscillation booster circuit means comprising a capacitor for intermittent oscillation and an oscillation circuit of the backswing voltage type, said oscillation circuit of said oscillation booster circuit means comprising a capacitor and a series circuit comprising a nonlinear inductor and a bidirectional diode thyristor, said capacitor for intermittent oscillation being connected in series with said series circuit of said oscillation circuit.

18. The system according to claim 17, wherein said discharge lamp means has filament means, and wherein said secondary winding of said current choke is connected to one of said filament means at the side of said discharge lamp means away from said power source, and to said oscillation booster circuit means so as to preheat said filament means by the input current for said oscillation booster circuit means.

19. The system according to claim 1, wherein said discharge lamp means is operated to draw a lamp current which establishes an effective lamp voltage value substantially equal to the effective source voltage of said a.c. power source.

20. A discharge lamp lighting system comprising a low frequency a.c. power source providing a low frequency output voltage, discharge lamp means, current limiting means connected between said a.c. power source and said discharge lamp means, booster circuit means including an oscillation circuit and a capacitor C2 for intermittent oscillation connected in series with each other, said oscillation circuit comprising a further capacitor C and a series circuit having a nonlinear inductor and a switching semiconductor connected in parallel with said further capacitor, said booster circuit generating an intermittent oscillation output voltage at a given period for each half cycle of said power source, voltage phase control means operatively connected to control the phase of said intermittent oscillation output voltage and of said a.c. power source for establishing an ignition of said discharge lamp within said given period, and energy coupling means for superposing said intermittent oscillation oiutput voltage with the low frequency output voltage of said a.c. power source to provide a superposed output voltage and means for applying said superposed output voltage to said discharge lamp means, wherein the source voltage from said a.c. power source and the lamp voltage of said discharge lamp means are substantially equal to each other to minimize said current limiting means, and whereby the ignition of said discharge lamp means in each half cycle of said a.c. power source is achieved mainly by said intermittent oscillation of said booster circuit means.

21. A discharge lamp lighting system comprising an a.c. power source, discharge lamp means having a given operating voltage and being connected to said a.c. power source, lamp current limiting means connected to said discharge lamp means for limiting and stabilizing the lamp current, oscillation booster circuit means generating an intermittent oscillation output, and coupling means operatively connecting said oscillation booster circuit means to said discharge lamp means, said coupling means supplying the intermittent oscillation output to said discharge lamp means for reigniting said discharge lamp means in each half cycle of the lamp current, said a.c. power source providing a source voltage, the effective value of which is substantially equal to the effective value of said lamp voltage.

* * * * *